US006663310B2

(12) United States Patent
Han

(10) Patent No.: US 6,663,310 B2
(45) Date of Patent: Dec. 16, 2003

(54) BUTTON BINDER

(76) Inventor: Nanlin Han, 3200 S. Barrington Ave., Suite D, Los Angeles, CA (US) 90066

( * ) Notice: Subject to any disclaimer, the term of this patent is extended or adjusted under 35 U.S.C. 154(b) by 77 days.

(21) Appl. No.: 09/755,548

(22) Filed: Jan. 5, 2001

(65) Prior Publication Data

US 2002/0131809 A1 Sep. 19, 2002

Related U.S. Application Data

(60) Provisional application No. 60/174,820, filed on Jan. 7, 2000.

(51) Int. Cl.[7] ..... B42F 3/00

(52) U.S. Cl. ..... 402/8; 24/67 R; 24/67.5; 281/21.1; 402/69; 402/70; 402/80 R; 402/502; D19/26

(58) Field of Search ..... 24/67 R, 67.5, 24/67.9, 67.11; 402/8, 68, 70, 69, 73, 64, 80 R, 500, 502; D19/26, 27, 32; 281/21.1, 36, 37, 38

(56) References Cited

U.S. PATENT DOCUMENTS

| | | | | | |
|---|---|---|---|---|---|
| 1,517,712 | A | * | 12/1924 | Davie | |
| 3,083,714 | A | * | 4/1963 | Foster | |
| 3,574,472 | A | * | 4/1971 | Colt | 402/22 |
| 4,340,316 | A | * | 7/1982 | Jahn | 402/61 |
| 4,525,899 | A | * | 7/1985 | Carroll | 24/545 |
| 4,606,097 | A | * | 8/1986 | Lam et al. | 24/102 R |
| 5,644,820 | A | * | 7/1997 | Ho | 24/113 MP |
| 6,076,990 | A | * | 6/2000 | Jahn | 281/15.1 |

* cited by examiner

*Primary Examiner*—Monica Carter

(74) *Attorney, Agent, or Firm*—Raymond Y. Chan; David and Raymond Patent Group

(57) ABSTRACT

The primary object of the present of invention is to provide a button binder in which paper or sheets can be easily retained and moved out, which exclude the above-mentioned disadvantages.

In accordance with one embodiment of the invention, the button binder includes several buttons, connection pieces, pulling pieces, a front sheet, a rear sheet and strips. An appropriate number of the buttons are fixed on the appropriate position on the binder, such as on the left portion or top portion of the rear sheet. The buttons mainly compromises a cap and a post. The cap has an axial hole. The post is capable of engaging in the axial hole of the cap and being fastened tightly. Punched papers or sheets can be hold by the post under the cap. When paper in the button binder is opened, there is big force to open the buttons. In order to secure the paper tightly, the buttons are designed to be opened only in a proper direction or site, and the buttons can not be opened in non-proper direction or site. Where the site of the button can be opened, the button cap and the post mesh by smooth curve faces as usual buttons. However, where the site of the button can not be opened, the button cap has tooth pawl, the button post also has latch tooth. They mesh together by teeth to firmly grasp paper. Moreover, where the button can not be opened, the button cap and post have enough touching length along the axial direction of the post, they engage by the longer contacting length (or area) along the post, the button also can not be opened from here. Another way is by latch rod of the cap and claw notch of post. The spring latch rod engages in the claw notch, the button also can not be opened from this place. To move the paper or sheets is easy and simple by a pulling action to open the proper place of the buttons, then all the button will be opened.

17 Claims, 23 Drawing Sheets

BUTTON BINDER

CROSS REFERENCE OF RELATED APPLICATION

This i s a non-provisional application of a provisional application, application No. 60/174,820, filed on Jan. 07, 2000.

BACKGROUND OF THE PRESENT INVENTION

1. Field of invention

The present invention relates to binders, folders and covers for holding a plurality of hole-punched papers or sheets to be stored and used.

2. Description of Related Arts

The most popular binder today is still ring binder. However, the ring binder has a complex structure and needs more space to install the rings in place. So the thickness of the ring binder is limited that it can not be made thin enough to fitly hold a few pieces of paper. In addition, the closing action of the ring binders is also dangerous to user, especially for children.

The present invention is provided to mitigate or obviate the afore-described disadvantages for the conventional ring binders.

SUMMARY OF THE PRESENT INVENTION

The primary object of the present of invention is to provide a button binder in which paper or sheets can be easily bound and unbound, so as to overcome the above-mentioned disadvantages.

In accordance with one embodiment of the invention, the button binder includes several buttons, connection pieces, pulling pieces, a front sheet, a rear sheet, and strips. A predetermined number of the buttons is affixed on the predetermined positions on the binder, such as on the left portion or top portion of the rear sheet. Each of the buttons mainly comprises a cap and a post. The cap h as an axial hole. The post is capable of engaging in the axial hole of the cap and being fastened tightly. Hole-punched papers or sheets can be held by the post under the cap. When paper in the button binder is opened, it applies a big force that may open the buttons. In order to secure the paper tightly, the buttons are designed to be opened only in a designated proper direction or site, and the buttons can not be opened in non-proper direction or site. When the site of the button can be opened, the button cap and the post mesh by smooth curve faces as usual buttons. However, when the site of the button can not be opened, the button cap has tooth pawl and the button post also has latch tooth. They mesh together by teeth to firmly grasp paper. Moreover, when the button can not be opened, the button cap and post have enough touching length along the axial direction of the post, wherein they engage by the longer contacting length (or area) along the post and the button also can not be opened from here. Another way is by latch rod of the cap and claw notch of post. The spring latch rod engages in the claw notch. The button can also not be opened from this place. To move the papers or sheets is as easy and simple as applying a pulling action to open the proper place of the buttons, and then all the buttons will be opened.

The button can be made of plastic or metal. The buttons can be affixed on the rear sheet without the front sheet. The buttons can also be affixed on a strip. The buttons can be used independently to hold papers. The button cap and the pulling piece can be made integrally. The button cap, the connection piece and the button post can be made integrally.

BRIEF DESCRIPTION OF THE DRAWINGS

FIG. 11 is a partial cross-sectional view of the button binder with latch teeth at one side in

FIG. 10.

DETAILED DESCRIPTION OF THE PREFERRED EMBODIMENT

Figure 1:
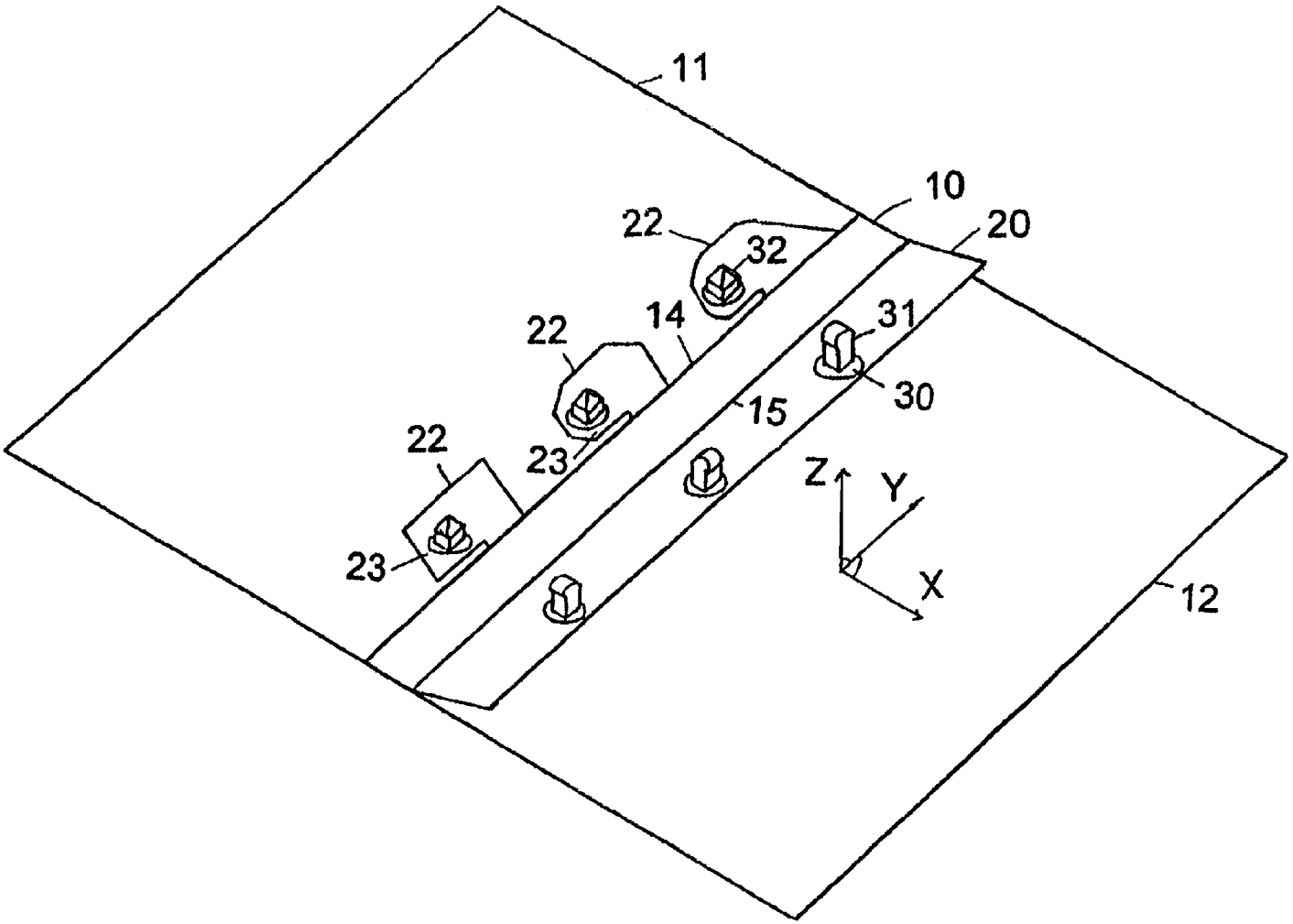
FIG. 1 is a perspective view of one embodiment of a button binder in accordance with the present invention when it is opened.

Referring to FIG. 1, a button binder 10 includes a front sheet 11, a rear sheet 12 connected with the front sheet 11, a strip 20, connection pieces 22 each having an integral pull piece 23, and a plurality of buttons 30 each comprising a button cap 32 and a button post 31 affixed on the predetermined positions of the binder 10. The button caps 32 are respectively affixed on the connection pieces 22 which are connected to the front sheet 11 or the rear sheet 12. The button posts 31 are affixed on the strip 20 or the rear sheet 12 if the button caps 32 are affixed on the front sheet 11. Folding lines 14, 15 are formed between the front sheet 11 and the rear sheet 12. The posts of the button posts 31 are constructed to be capable of passing through the holes punched in papers or sheets. By pushing the button cap 32 or the button post 31 to insert the post into a hole of the button cap 32, they will engage tightly to hold the papers between the button cap 32 and the button post 31 of the button. To open the, button cap 32, along a latitude direction (X direction), or a longitude direction (Y direction) or other designated proper direction, depending on the direction of the button installed. When the buttons are opened, the connection piece 22 keeps the button caps 32 connecting to the front sheet 11 or the rear sheet 12.

Figure 2:
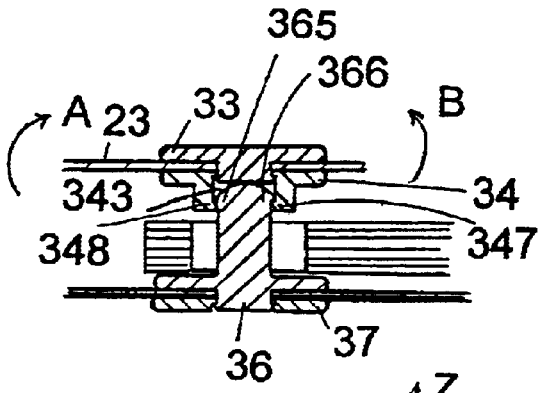
FIG. 2 is a partial cross-sectional view of a button binder with latch teeth at one side.
Figure 3:
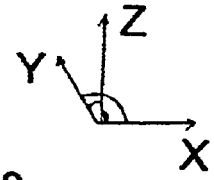
FIG. 3 is a partial cross-sectional view of a button binder with big contacting area at side.
Figure 3:
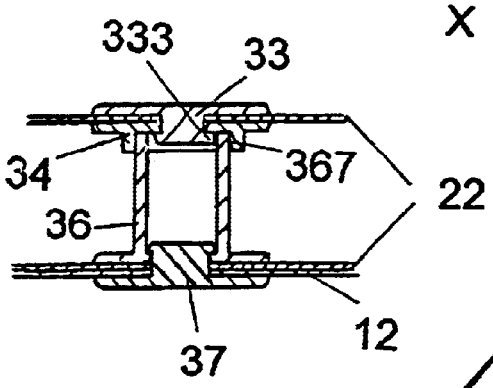
Figure 4:
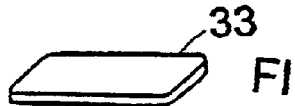
FIG. 4 is a perspective view of a button cap base.
Figure 5:
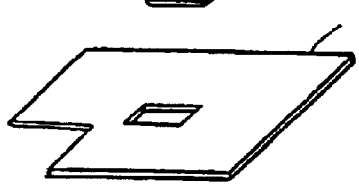
FIG. 5 is a perspective view of connection and pull piece.
Figure 6:
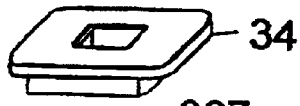
FIG. 6 is a perspective view of a button cap.
Figure 7:
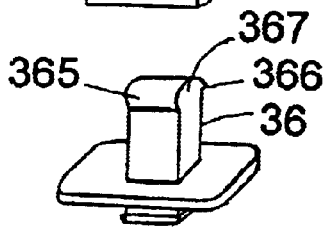
FIG. 7 is a perspective view of a button post.
Figure 8:
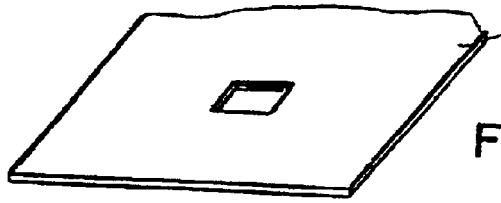
FIG. 8 is a perspective view of a partial rear sheet.
Figure 9:
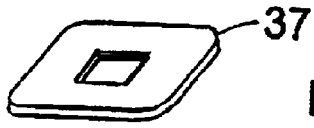
FIG. 9 is a perspective view of a button post base.

As shown in FIG. 2, one embodiment of the button is shown, wherein FIG. 4 to FIG. 9 illustrate its components. The button cap 32 comprises a cap base 33 (as shown in FIG. 4) and a button cap 34 (as shown in FIG. 6). Button post 31 comprises a button post 36 (as shown in FIG. 7) and a post base 37 (shown in FIG. 9). The cap base 33 and the cap 34 are snapped on the connection piece 23 tightly. The shape of the post 36 can be square or rectangular or other geometry shape as shown in FIG. 7.

The post 36 has an enlarged head at a top end thereof, wherein the enlarged head has a smooth curve portion 365 at a first side of the post 36 and extends to form a sharp shoulder (tooth pawl) 366 at an opposite second side. The other third and fourth sides of the post 36 have the flat surfaces 367. The cap 34 has a square or rectangular hole with respect to the post 36 with a mouth provided downwards. A first side of the mouth has a smooth curve edge 348, and the opposite side has a sharp shoulder edge 347 (as shown in FIG. 2). The other two third and fourth sides are flat surfaces too. When the post 36 engages in the hole 343 of the cap 34, the smooth curve edge 348 and the smooth curve portion 365 fit with each other to form a smooth curve site and the sharp shoulder (tooth pawl) 366 and the sharp shoulder edge 347 latch with each other to form a tooth pawl site. In this way, the button 34 can only be opened at the first side through the smooth curve site in the direction pointed by arrow A in FIG. 2, and can not be opened in the other three direction, i.e. the second, third and fourth sides. If the tooth pawl site is also made smooth curve without tooth, the button .34 only can be opened in the two smooth curve sites, and can not be opened from the flat area sites, i.e. the third and fourth sides. The. cap 34 and post 36 slightly contact the flat surfaces 367 each of which has a length long enough along the axis of the post 36. The button 34 can not be opened from the third or fourth sides, i.e. the flat area sites because there is no enough space. So, the buttons 34 can be installed in the binder only if the smooth curve site or direction is not used to secure papers when the users leaf through the papers during reading (not along the direction which the paper is turned over for reading). As a result, when the paper is turned over for reading, the buttons are remained being locked tightly at the same time.

Figure 10:
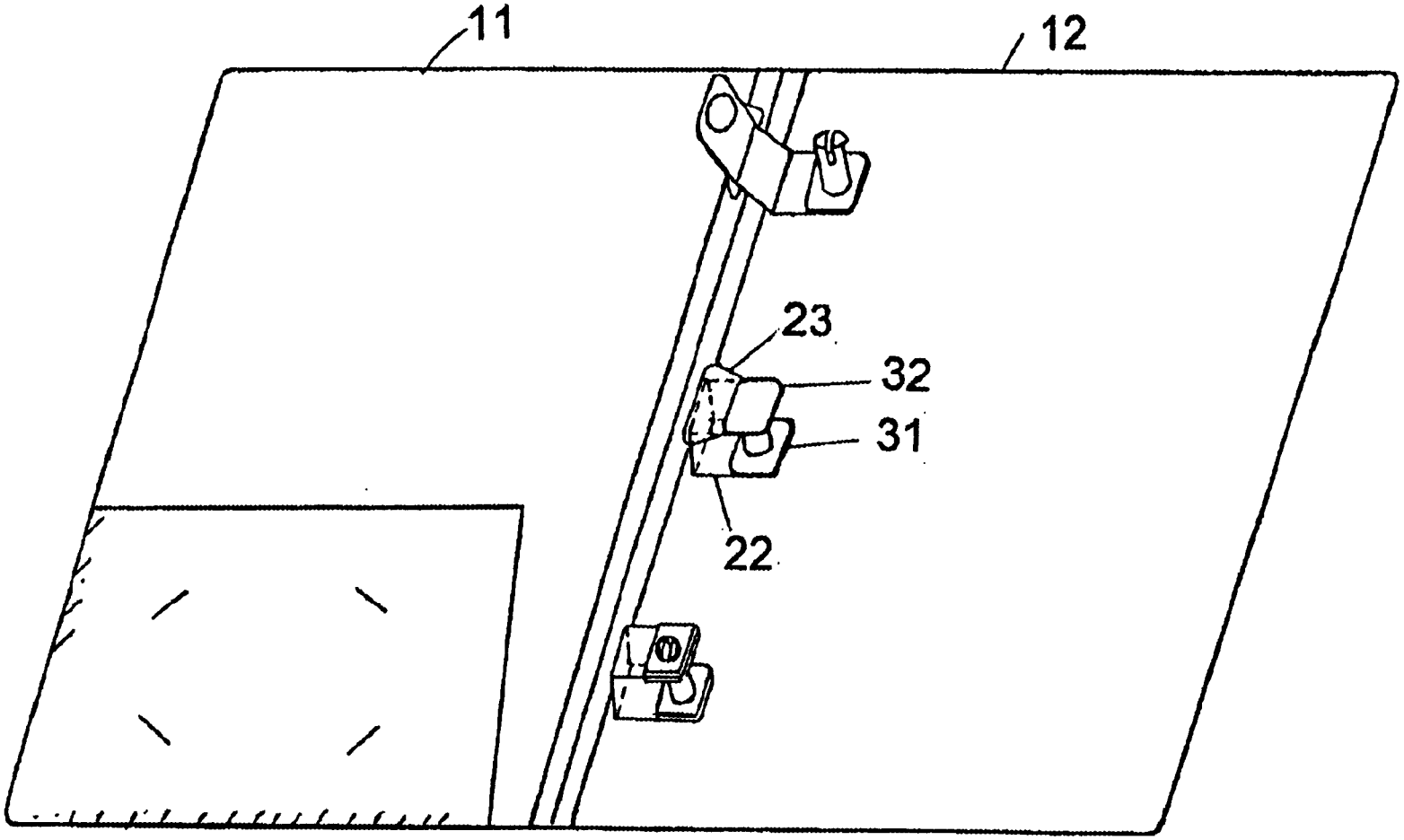
FIG. 10 is a perspective view of one embodiment of the button binder when it is opened.

FIG. 10 illustrates one embodiment of the button binder in which the button post 31 is alternatively affixed together with the connection piece 22 on the rear sheet 12 while the pull piece 23 locates just above the connection piece 22.

Figure 11:
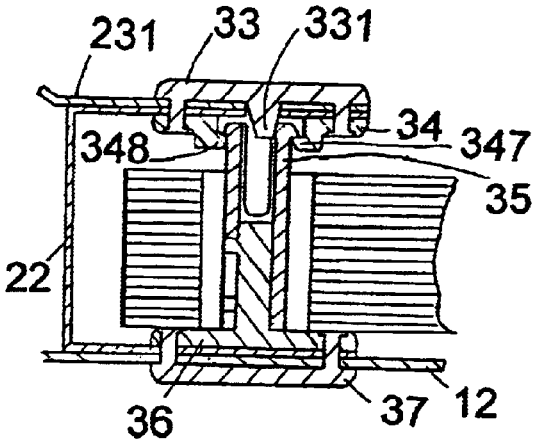
Figure 12:
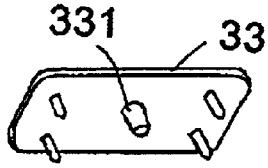
FIG. 12 is a perspective view of a button cap base.
Figure 13:
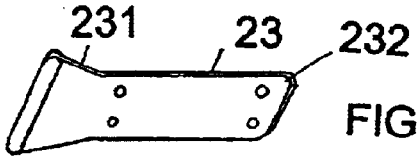
FIG. 13 is a perspective view of the pull piece.
Figure 14:
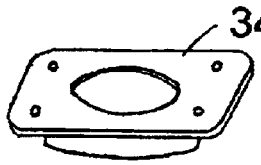
FIG. 14 is a perspective view of a button cap.
Figure 15:
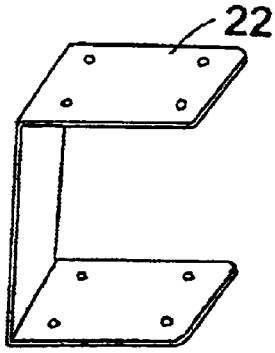
FIG. 15 is a perspective view of a connection piece.
Figure 16:
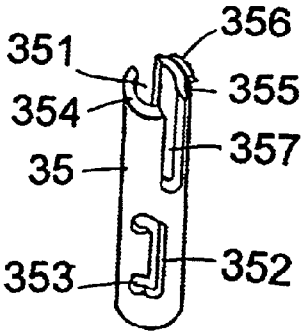
FIG. 16 is a perspective view of movable part of post of button.
Figure 17:
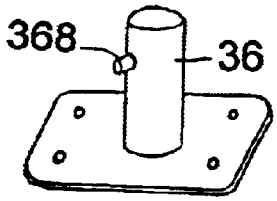
FIG. 17 is a perspective view of a button post.
Figure 18:
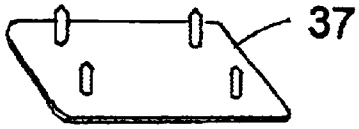
FIG. 18 is a perspective view of a button post base.

As shown in FIG. 11, one embodiment of button with latch teeth at one side is illustrated. FIGS. 12–18 show its components. The button comprises a cap base 33, a pull piece 23, a button cap 34, a connection piece 22, a post tube 35, a post 36, and a post base 37. The cap base 33 is affixed to the pull piece 23 and the cap 34 is affixed on the connection piece 22. The post base 37 is affixed to the connection piece 22 and the post 36 is affixed on the rear sheet 12. The pull piece 23 has a flap 231 extending out of the button cap 34. Pull the flap 231 to open the button.

The post 36 has a circle shape in cross section. The post tube 35 engages with the post 36 by its central hole 351. The post tube 35 has a groove notch 352. There are small holes 353 in the diameter direction at the end of the groove notch 352. A short small rod 368 is extended out from the button post 36 to hold the post tube 35 on a predetermined position. thereof Twist the post tube 35 to move the rod 368 out of the hole 353 to the groove notch 352. Then, slide the post tube 35 along the post 36 resulting in extending the length for holding papers.

There is a bifurcated post that forms a pair of posts or legs 354 and 355 at a top portion of the post tube 35. The top end of leg 355 has a tooth pawl 356. Another end of the leg 354 is smoothly curved as usual buttons. One side of the mouth of button cap 34 has a smooth curve portion 348 and the opposite side has a sharp tooth latch 347. When the post 36 engages in the cap 34, the smooth curve portion 348 and the smooth curved leg 354 fit with each other to form a smooth curve site and the. tooth pawl 356 and the sharp tooth latch 347 mesh with each other. In this way, the button can only be opened from the smooth curve site. The split notch 357, between legs 354 and 355, makes the two legs easy to bend into the button cap 34. The legs 354 and 355 are strong and stiff enough to stay in the button cap 34. When the button is closed, the small post 331, extending form the center of cap base 33, inserts into the split notch 357 to hold the leg 355. There is not enough space between the small post 331 and the leg 355 due to the length of the post 331 for opening the button at this site. This small post 331 secures the grasped site of the button. However there is enough space between the small post 331 and the smooth curve leg 354 for opening the button from this site.

Figure 19:
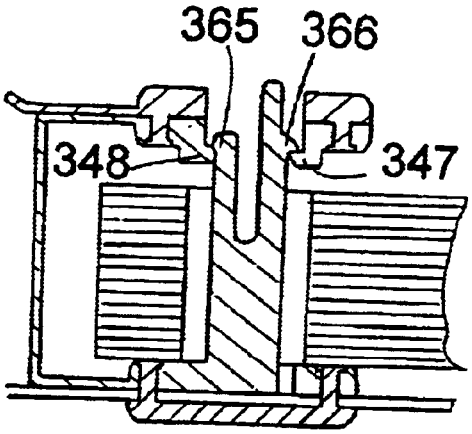
FIG. 19 is a partial cross-sectional view of one embodiment of the button with top hole.
Figure 20:
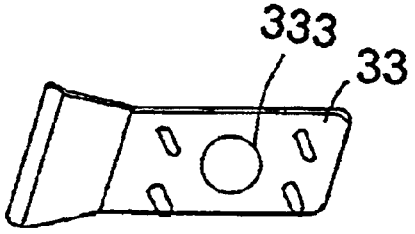
FIG. 20 is a perspective view of a button cap base.
Figure 21:
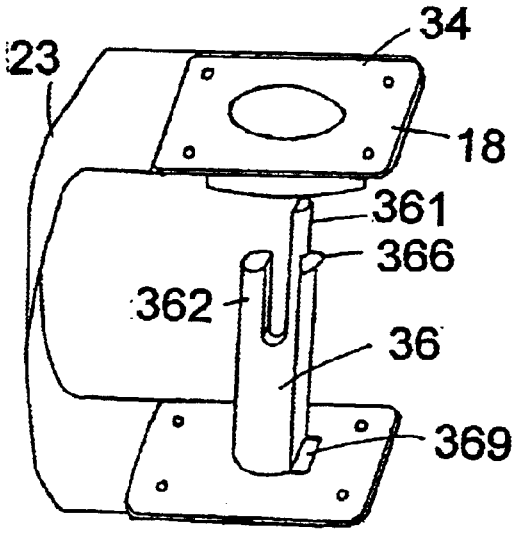
FIG. 21 is a perspective view of the button cap, pull piece and button post made integrally.

FIG. 19 is a partial cross-sectional view of one embodiment of button and FIGS. 20 and 21 show its components, including the button cap 34, the connection piece 23 and the button post 36 which are made integrally to form a single button 18. The pull piece 23 is integrally made with the cap base 33. The leg 361 with the latch tooth 366 is longer than the leg 362. The leg 361 can be extended out of the central hole 233 of the pull piece 23 when the button is closed. To use nail of finger to push the end of leg 361 toward another leg 362, the teeth 366 and 347 will open. So the button is opened. Smooth curved head 365 and the smooth curve portion 348 have a lean angle in order to release their elastic force to open the button when a tooth pawl 366 and the sharp tooth latch 347 are unlocked. There is a hole 369 provided at the root of the post 36 which is used during manufacturing for the tooth pawl 366.

Figure 22:
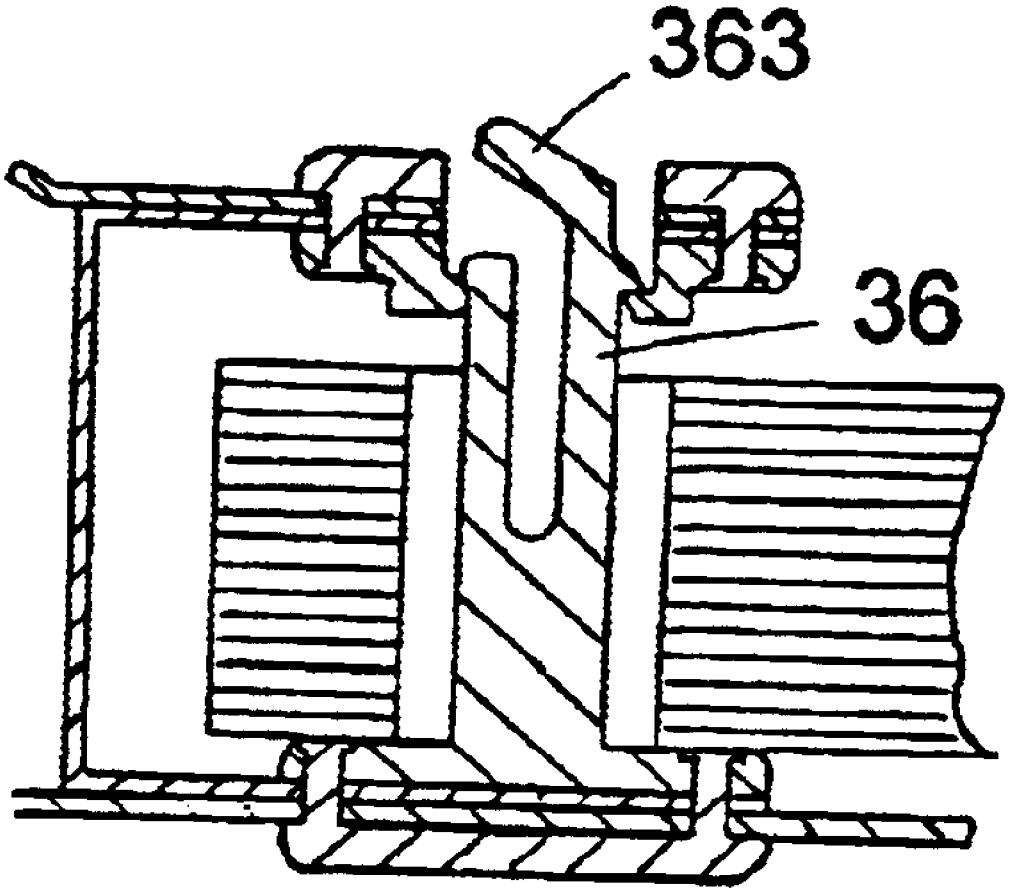
FIG. 22 is a partial cross-sectional view of one embodiment of the button.

FIG. 22 is a partial cross-sectional view of one embodiment of the button similar to the embodiment as shown in FIG. 19, wherein there is a handle 363 provided at the end of the leg 36 with the tooth pawl. The handle 363 has an angle with the leg 36. Open the button by pushing the handle 363.

Figure 23:
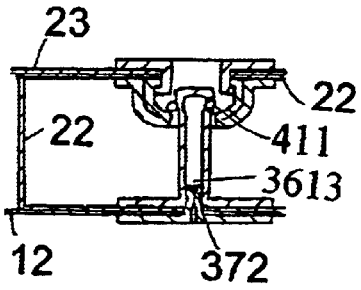
FIG. 23 is a partial cross-sectional view of one embodiment of the button with latch rod.
Figure 24:
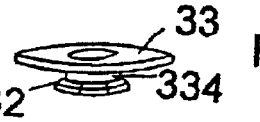
FIG. 24 is a perspective view of a button cap base.
Figure 25:
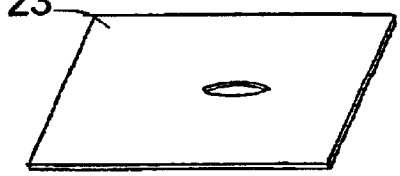
FIG. 25 is a perspective view of the connection and pull piece.
Figure 26:
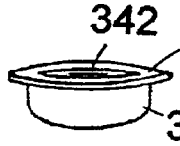
FIG. 26 is a perspective view of a button cap.
Figure 27:
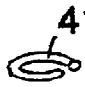
FIG. 27 is a perspective view of a curve spring rod.
Figure 28:
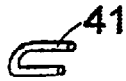
FIG. 28 is a perspective view of a straight latch rod.
Figure 29:
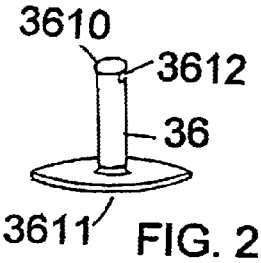
FIG. 29 is a perspective view of a button post with notch.
Figure 30:
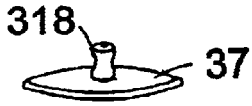
FIG. 30 is a perspective view of a button post base.

FIG. 23 is a partial cross-sectional view of one embodiment of button. FIGS. 24 to 30 show its partial components. The button comprises a button cap base 33, a pull piece 23, a button cap 34, a connection piece 22, a U-shaped spring 41, a button post 36, and a post base 37. In the center of the cap base 33, there is a projection 334 facing downwards which has an enlarged portion 332 at the end of the projection 334. The cap 34 centrally has a belly projection 341 facing downwards with an axial hole 342 which has a middle segment greater in diameter than an upper segment and a lower segment thereof. The spring 41 is holed in the middle segment. The projection 334 of the cap base 33 can be pressed into the hole 342 of the button cap 34 tightly through the holes of the pull piece 23 and the connection piece 22 to affix the button cap 34 on the. connection piece 22.

The button post 36 is at the center of the button. The upper end of the button post 36 has an enlarged head 3610 having a diameter larger than the button post 36. The post 36 is a hollow tube having a smaller mouth 3611 facing downwards. The button post 36 is capable of piercing in the space where the spring 41 is provided. There is a latch notch 3612 provided adjacent to the head 3610. At the opposite side of the latch notch 3612, the head 3611 has a smooth curve edge. A leg 411 of the spring 41 meshes in the latch notch 3612 when the button is closed. The leg 411 is retained securely in the latch notch 3612. Therefore, the button can not be opened from the grasped site of the latch notch 3612 and the spring 41. The button can only be opened from the opposite smooth curve edge.

The button post 36 has an axial hole 3613 at its bottom. The post base 37 also has an upward nail 372 with an enlarged head which can be tightly engaged into the mouth 3613 of the button post 36 to fasten the button post 36 and the connection piece 23 on the rear sheet 12.

Figure 31:
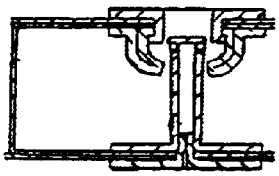
FIG. 31 is a partial cross-sectional view of one embodiment of the button which post with two latch pawls.
Figure 32:
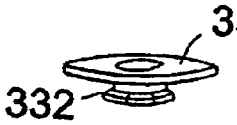
FIG. 32 is a perspective view of a button cap base.
Figure 33:
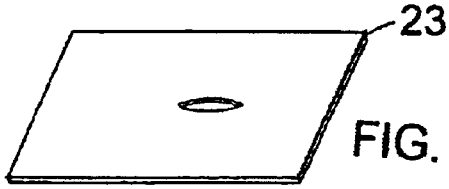
FIG. 33 is a perspective view of the connection and pull piece.
Figure 34:
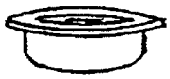
FIG. 34 is a perspective view of a button cap.
Figure 35A:
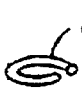
FIG. 35 is a perspective view of a string latch rod.
Figure 35B:
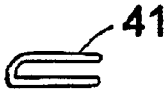
Figure 36:
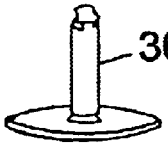
FIG. 36 is a perspective view of a button post with two notches.
Figure 38:
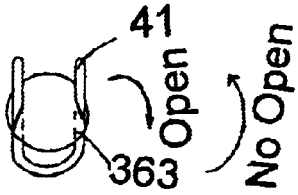
FIG. 38 shows the string rod and post notches are engaged.
Figure 37:
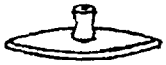
FIG. 37 is a perspective view of a button post base.
Figure 39:
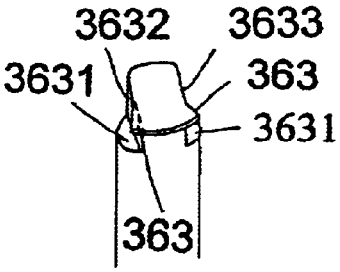
FIG. 39 is a perspective view of a button post end.

FIG. 31 is a partial cross-sectional view of one embodiment of button similar to the embodiment as shown in FIG. 23. FIGS. 31 to 37 show its components. The different between the structure as shown in FIG. 31 and FIG. 23 is the head of the post 36. The new embodiment of the head of the post 36 in FIG. 31 has two latch teeth 363 at half circle of the head (as shown in FIG. 39). Under the two latch teeth 363, there are two notches 3631. The opposite half circle part 3632 of the head has no latch teeth and is smooth to the notches 3631. There are smooth curve edge 3633 from the latch tooth 363 transferring to no tooth head 3632. The two legs of the spring 41 engage in the notches 3631 respectively when the button is closed (as shown in FIG. 38). Therefore the button can be opened from the side has no latch teeth by the legs of spring 41 moving along the smooth curve edge 3633. The button can not be opened at the site of the latch teeth 363.

Figure 40A:
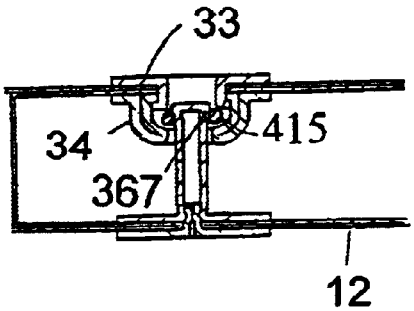
FIG. 40 is a partial cross-sectional view of one embodiment of the button whose post locks with latch rod by big contacting area.
Figure 40B:
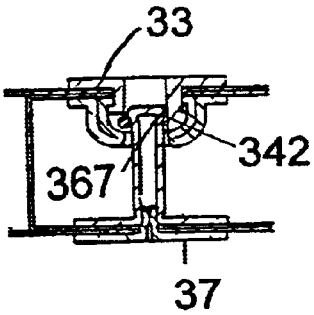
Figure 41:
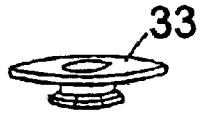
FIG. 41 is a perspective view of a button cap base.
Figure 42:
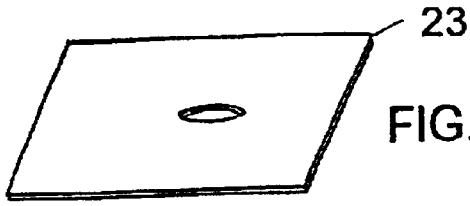
FIG. 42 is a perspective view of the connection and pull piece.
Figure 43:
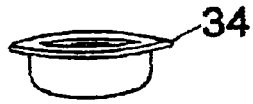
FIG. 43 is a perspective view of a button cap.
Figure 44:
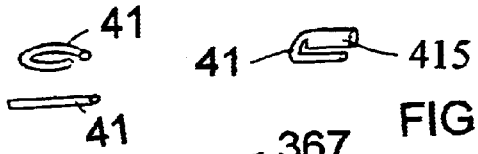
FIG. 44 is a perspective view of a string latch rod.
Figure 45:
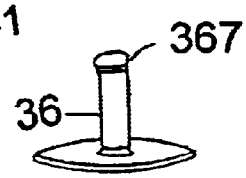
FIG. 45 is a perspective view of a button post.
Figure 46:
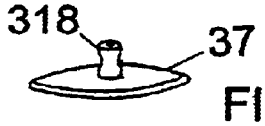
FIG. 46 is a perspective view of a button post base.

FIG. 40 is a partial cross-sectional view of one embodiment of button similar to the embodiment as shown in FIG. 23 and FIG. 31. FIGS. 41 to 46 show its components. The different between the structure as shown in FIG. 40 and FIG. 23 is the head of the post 36 and the shape of the leg of spring 41. One side of the post 36 is a flat surface. One leg of the spring 41 is also a flat leg 415. The flat area of the flat leg 415 and the post 36 engage together and the button can not be opened here. It is similar to the enough contacting length along the post mentioned above. The button can also be one side of the button post 36 and the button cap 34 has the spring 41. The opposite site of the post 36 and the cap 34 is flat area.

Figure 47:
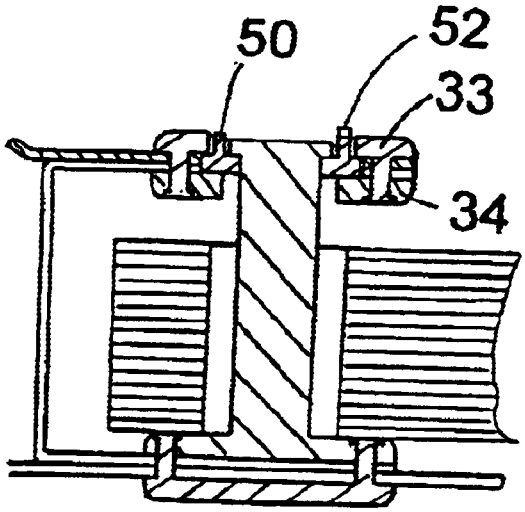
FIG. 47 is a partial cross-sectional view of one embodiment of the button whose post locked by turning latch.
Figure 48:
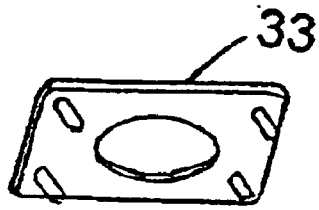
FIG. 48 is a perspective view of a button cap base.
Figure 49:
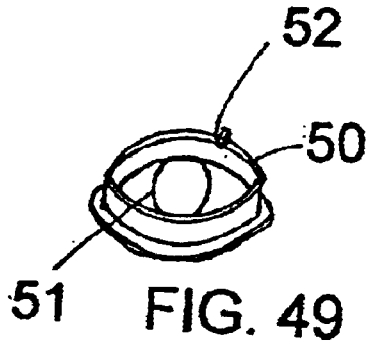
FIG. 49 is a perspective view of the turning latch.
Figure 50:
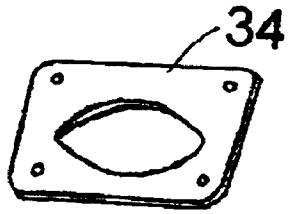
FIG. 50 is a perspective view of a button cap.
Figure 51:
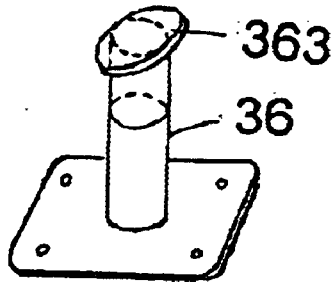
FIG. 51 is a perspective view of a button post with a big geometry end.

FIG. 47 is a partial cross-sectional view of one embodiment of button. FIGS. 48 to 51 show its special components. There is a turning latch plate 50 provided between the button cap base 33 and the button cap 34. The turning latch plate 50 can be turned within the button cap 34 by moving a small handle 52 thereof. There is a central hole 51 formed in the center of the latch plate 50. The hole 51 has a larger diameter in one direction and a smaller diameter in the other direction. For example, ollive shape. The head of the post 36 also has a latch 363 having a longer length in one direction and a shorter length in the other direction. The shorter length of the post 36 is shorter than the smaller diameter of the hole 51. The longer length of the post 36 is shorter than the larger diameter of the hole 51. The longer length of the post 36 is longer than the smaller diameter of the hole 51. So the head latch 363 of the post 36 can be inserted into the hole 51. Turn the turning latch plate 50, the latch 363 of the post 36 will be locked by the smaller part of the hole 51. In this way, turn the turning plate 50 to open or lock the button.

The turning pate 50 can be modified to install on the top end of the post 36 instead of installing it between the button cap 34 and the cap base 33.

Figure 52:
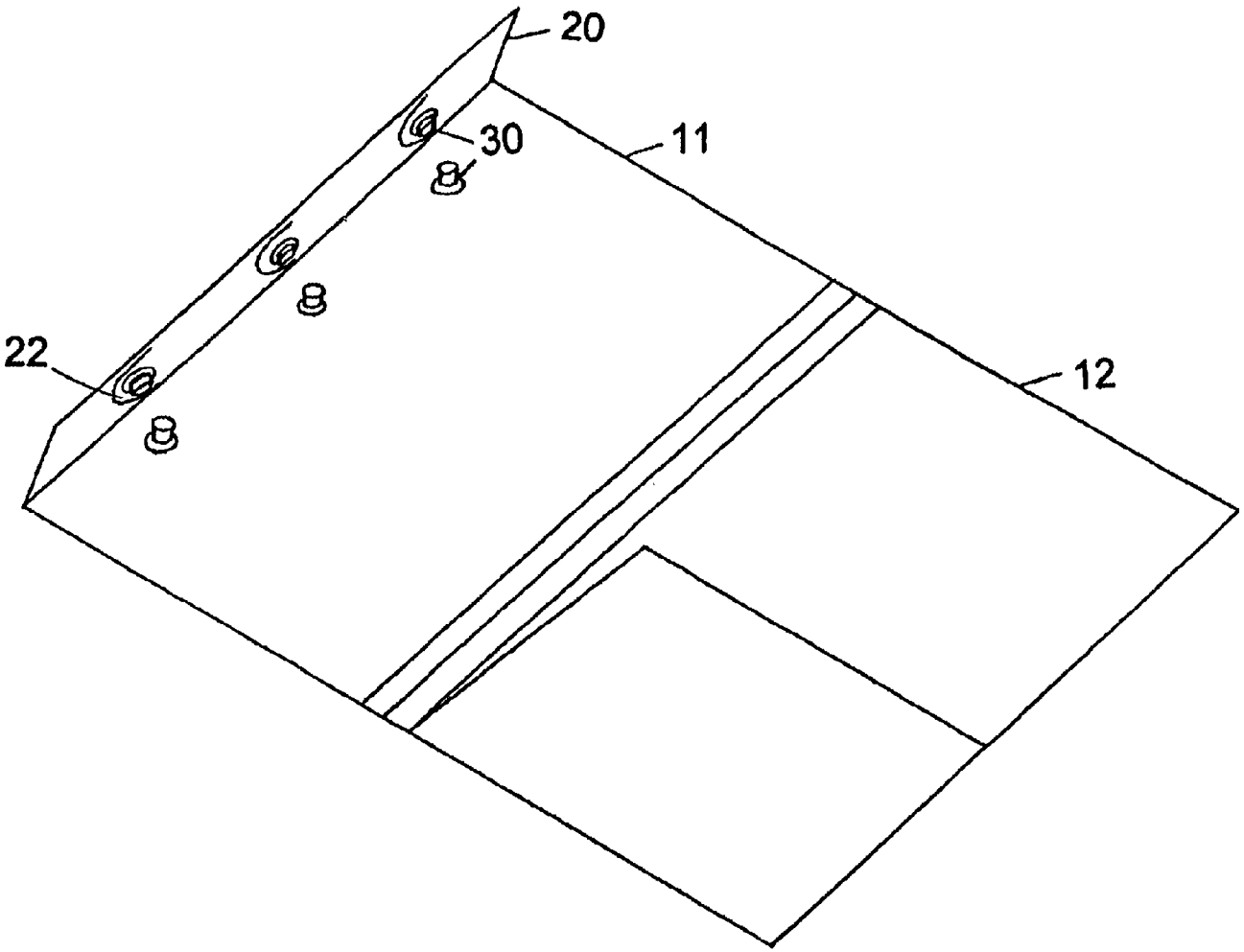
FIG. 52 is a perspective view of one embodiment of the button binder in which the buttons are affixed on the left side of front sheet.

As shown in FIG. 52, the buttons are installed at the left side of the front sheet 11 and the button cap are fixed on the strip 20 which is connected to front sheet 11. The pull piece 22 is a part of the strip 20.

Figure 53:
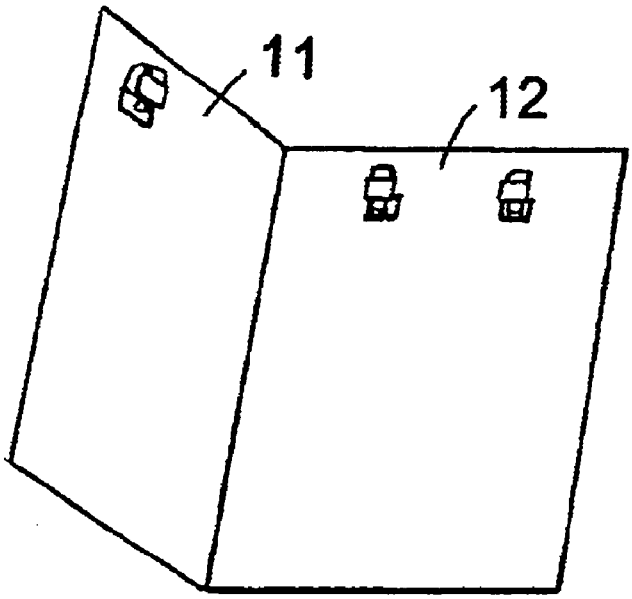
FIG. 53 is a perspective view of one embodiment of the button binder in which the buttons are affixed on the top side of rear sheet.

As shown in FIG. 53, the buttons are installed at the top side of the rear sheet 12. One embodiment is that it can be only the buttons and the rear sheet without front sheet.

Figure 54:
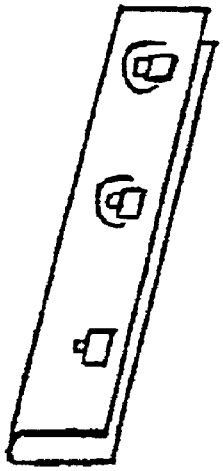
FIG. 54 is a perspective view of one embodiment of the button binder in which the buttons are affixed on the strip.

As shown in FIG. 54, the buttons are installed on a strip 20 without the front sheet and the rear sheet.

Figure 55:
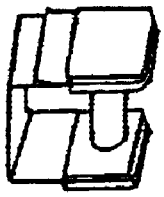
FIG. 55 is a perspective view of one embodiment of the button binder in which the button can bind paper along.

As shown in FIG. 55, the button can hold paper alone without the strip and the cover sheets.

Figure 56:
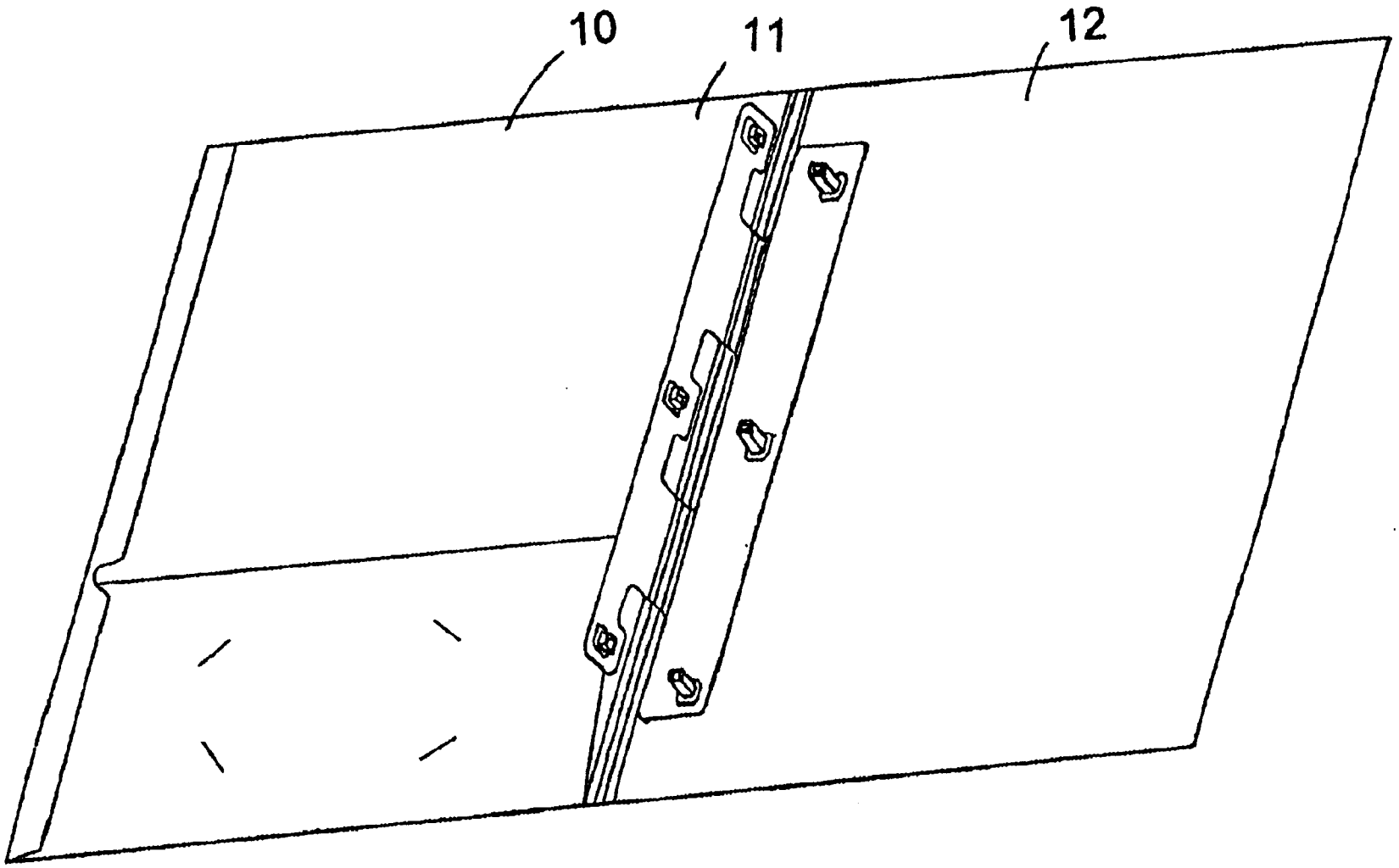
FIG. 56 illustrates one embodiment of the button binder with a kind of connection piece.

FIG. 56 illustrates one embodiment of the button binder with a kind of connection piece.

Figure 57:
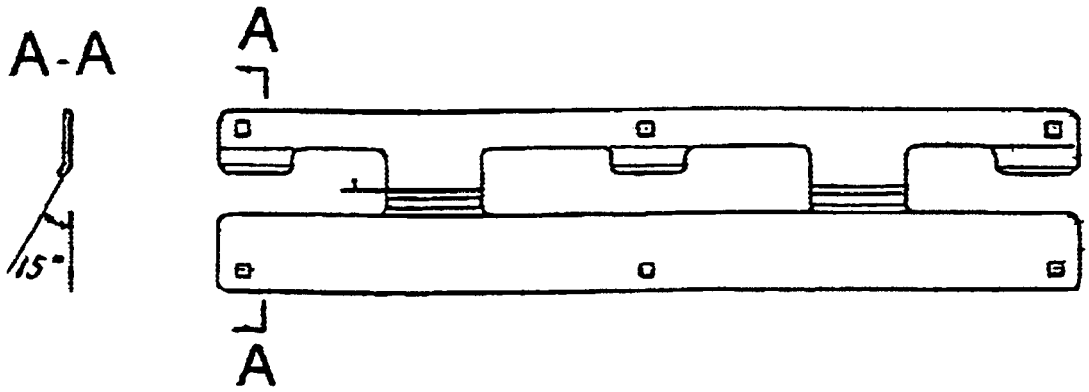
FIG. 57 illustrates one embodiment of the connection piece.

FIG. 57 illustrates one embodiment of the connection piece.

Figure 58:
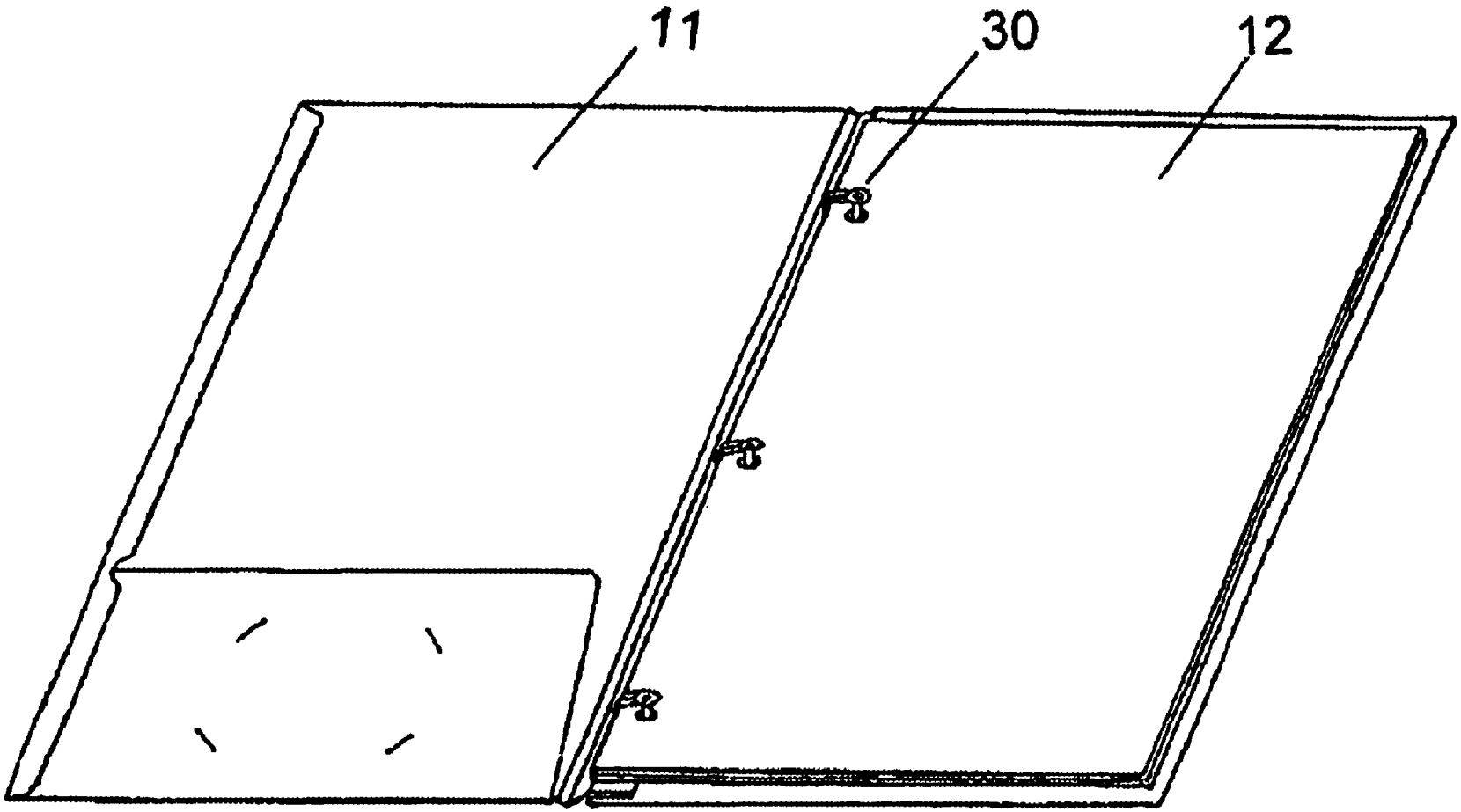
FIG. 58 illustrates one embodiment of the button binder with integrally made button cup and connection piece.

FIG. 58 illustrates one embodiment of the button binder with integrally made button cup and connection piece.

Figure 59:
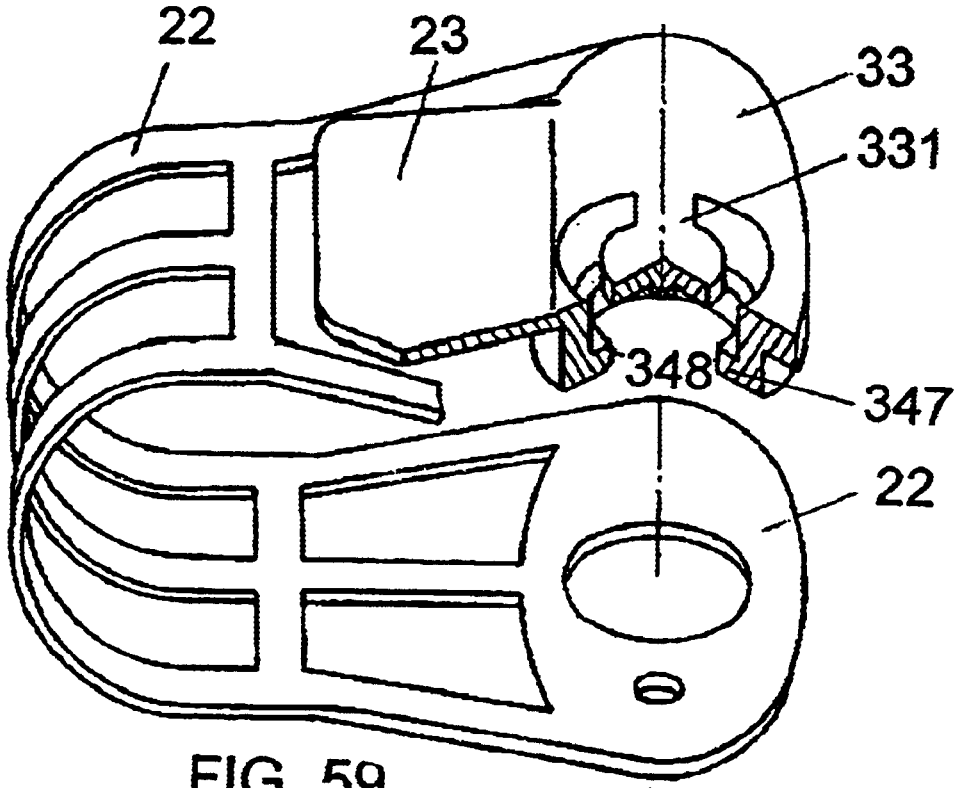
FIG. 59 illustrates one embodiment of the integrally made button cup and connection piece.

FIG. 59 illustrates one embodiment of the integrally made button cap and connection piece.

Figure 60:
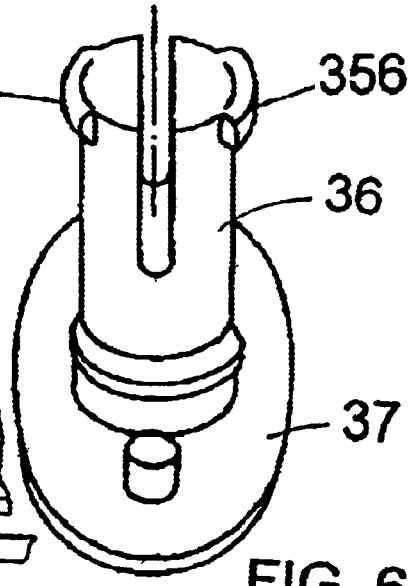
FIG. 60 illustrates one embodiment of the integrally made button post and post base.

FIG. 60 illustrates one embodiment of the integrally made button post and post base.

Figure 61:
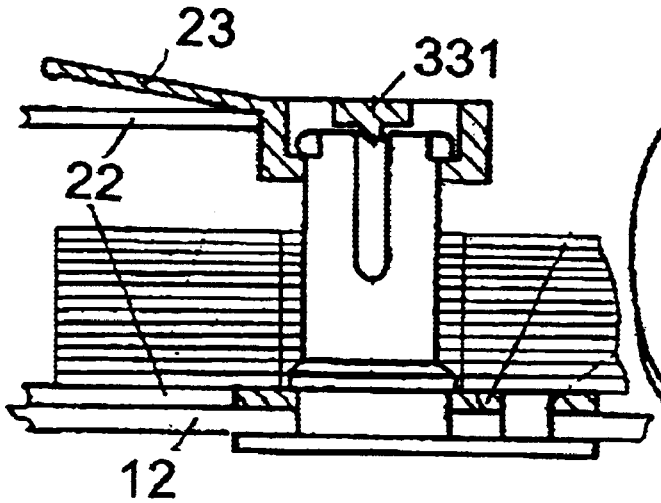
FIG. 61 is a partial cross-sectional view of one embodiment of the button with post and integrally made button cup and connection piece.

FIG. 61 is a partial cross-sectional view of one embodiment of the button with post and integrally made button cup and connection piece. The button only has two parts. The button cap and the connection piece are integrally made. One end of the connection piece is affixed to the button post on the cover.

Figure 62:
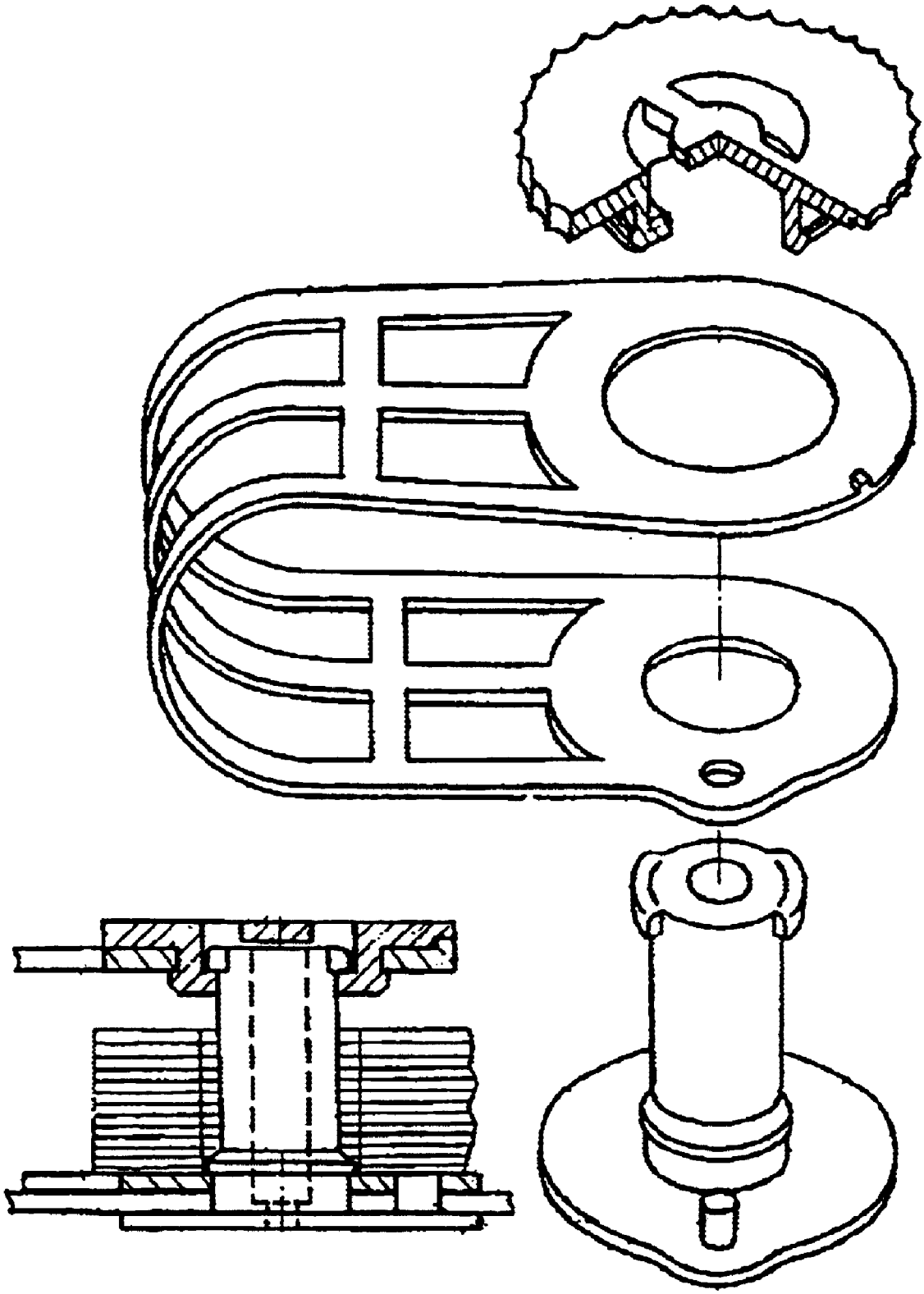
FIG. 62 illustrates one embodiment of the button binder with a turning plate.

FIG. 62 illustrates one embodiment of the button binder with a turning plate. Turn the plate of button cap to lock or unlock the button.

Figure 63:
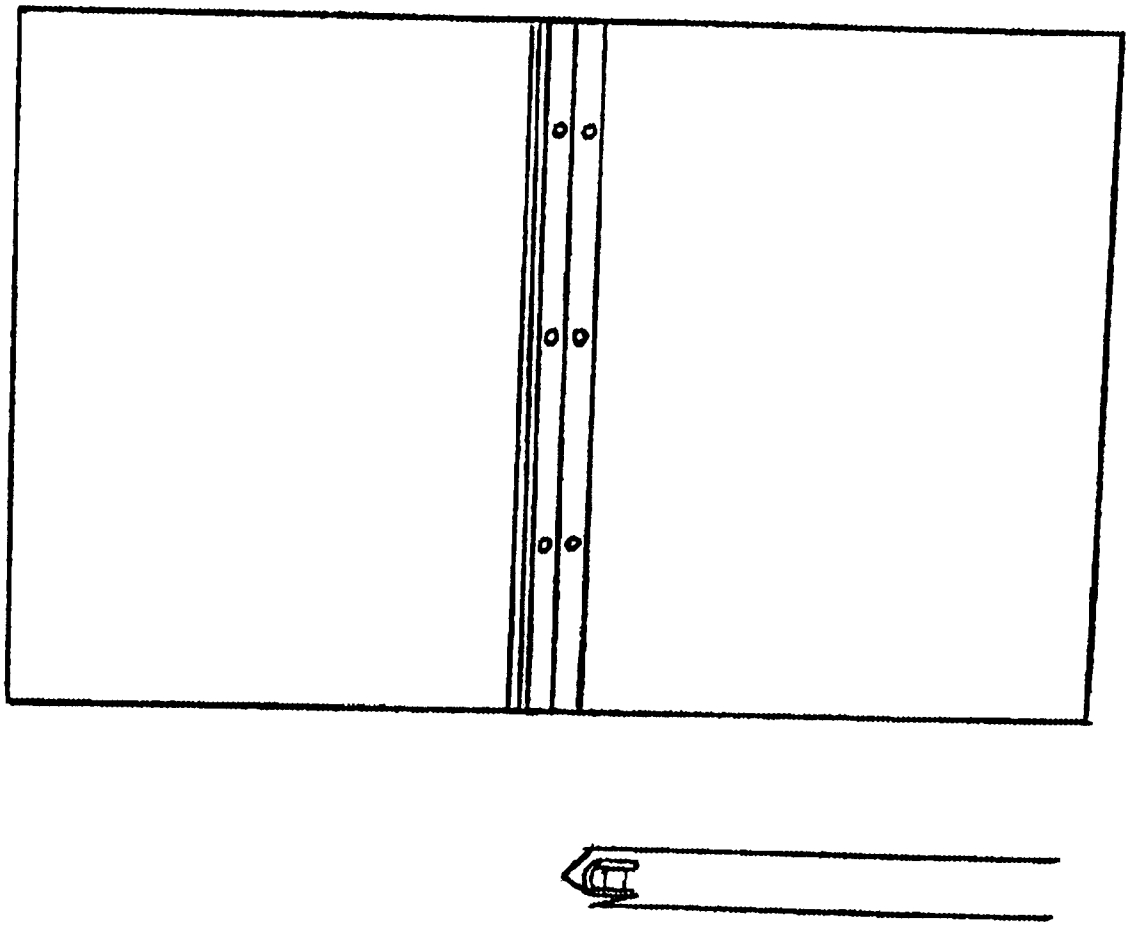
FIG. 63 illustrates one embodiment of the binder cover and how to fold the cover.
Figure 64A:
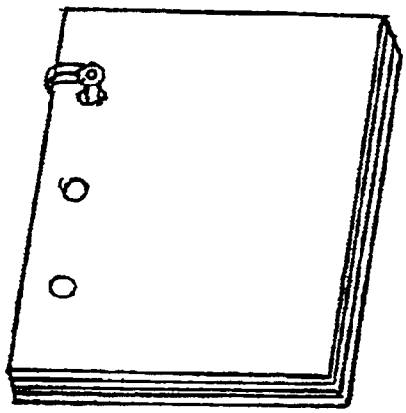
FIG. 64 shows the position and number of buttons and types of binders.
Figure 64B:
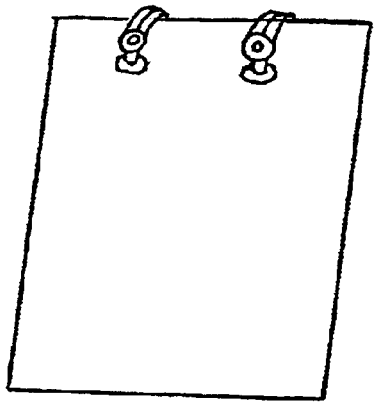
Figure 64C:
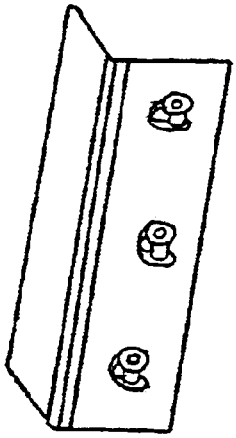
Figure 64D:
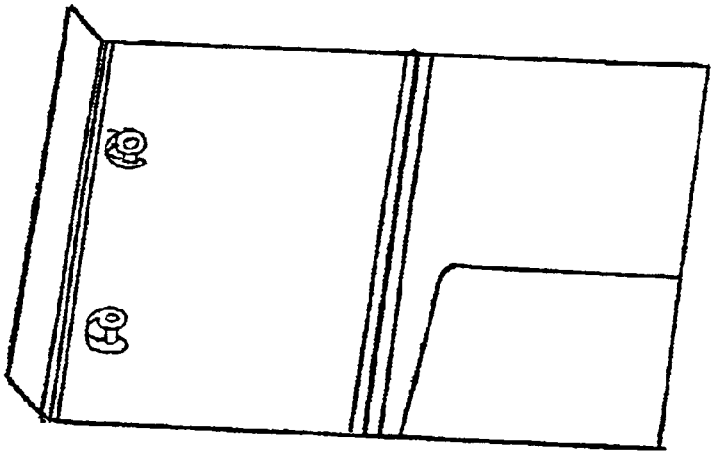

FIG. 63 illustrates one embodiment of the binder cover and how to fold the cover to get fold-line and the position to install buttons.

FIG. 64 shows the position and number of buttons and types of binders. The button can be installed on covers and strips or be used by itself.

Figure 65:
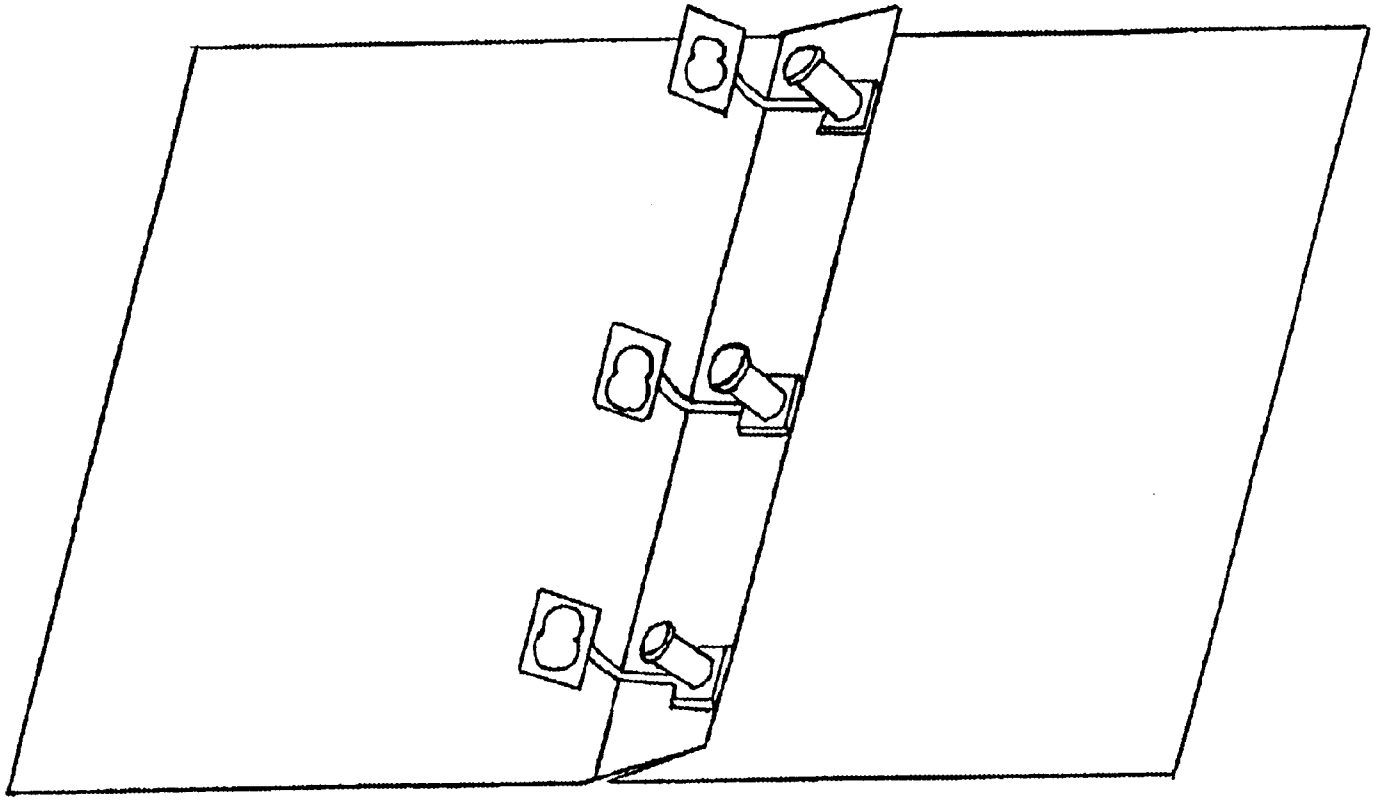
FIG. 65 illustrates one embodiment of the button binder with separate cap.

FIG. 65 illustrates one embodiment of the button binder with separate cap. It is a simple button cap having just a piece with dumb-bell-like holes which connect to or integrally made with connection ties. The dumb-bell hole have two cycles, wherein one cycle has a bigger diameter enough for the enlarged head of the button post to insert, and another cycle has a smaller diameter enough to hole the neck of post tightly, to open the button, to switch the head of post to the bigger cycle, to lock the button switch the post to the small cycle. The cap maybe just separately having one dumb-bell hole.

Figure 66:
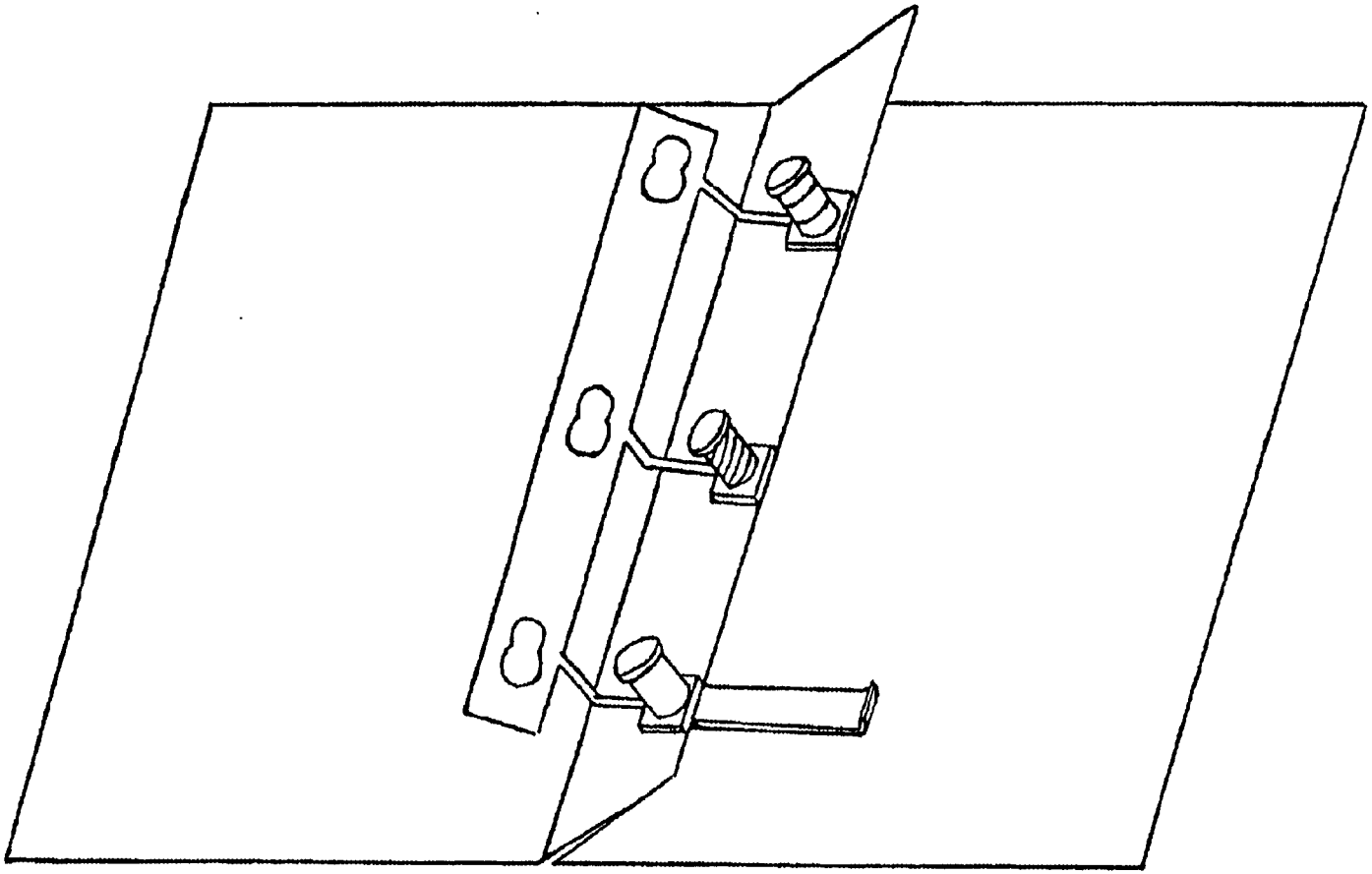
FIG. 66 illustrates one embodiment of the button binder with whole piece of cap.

FIG. 66 illustrates one embodiment of the button binder with a whole piece of cap. The cap has several dumb bell holes to match the posts.

Figure 67A:
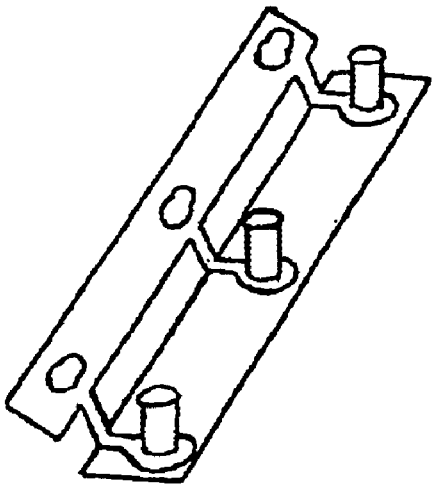
FIG. 67 shows several embodiments of the button binder.
Figure 67B:
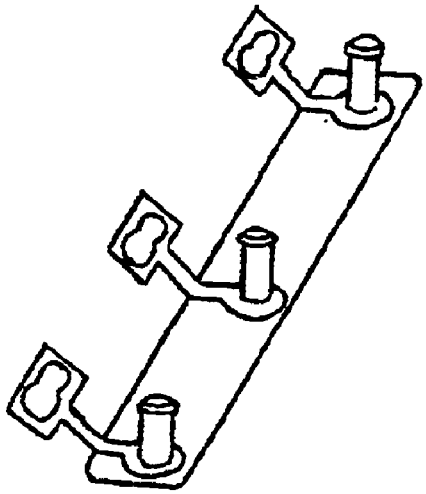
Figure 67C:
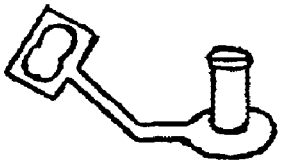
Figure 68A:
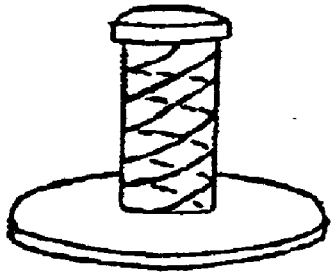
FIG. 68 shows several embodiments of button posts that can be extensible.
Figure 68B:
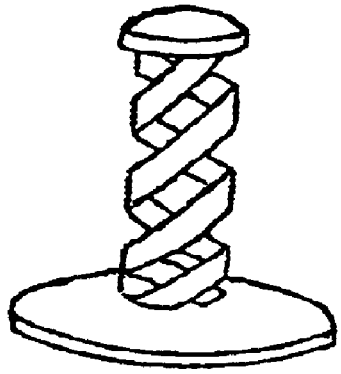
Figure 68C:
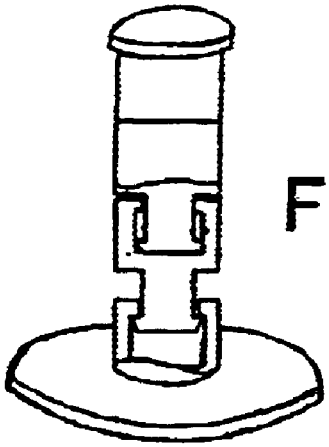
Figure 68D:
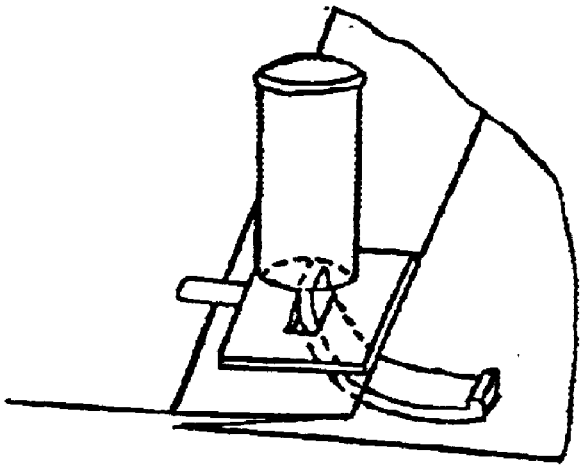

FIG. 67 shows several embodiments of the button binder. The button posts are separately or connected by a strip. There is an optional for the button. Single button still works for binding paper.

FIG. 68 shows several embodiments of button posts that are extensible. For extensible, the button post could be spring, snap cylinder or has a tail for extending the length. The tail is inserted into a hole of post base with a bigger end. The tail moves through the hole to extend the post. The bigger end keeps the tail stay in the hole of post base. The tail is made by band, tie, chain, or string.

What I claim as my invention is:

1. A button binder for binding papers each having at least a punched hole along one edge thereof, wherein said button binder comprises at least a button which comprises:

a button post comprising a post constructed for passing through said punched holes of said papers and a locking head provided at a top end of said post;

a button cap having a cap hole for receiving said locking head of said post of said button post therein; and means for securely fastening said locking head in said cap hole at a designated direction for holding said papers between said button post and said button cap in such a manner that said button cap is tightly engaged with said locking head of said post of said button post at a locking side to prevent said button cap from pulling apart from said locking head of said button post while leafing through said papers bound between said button post and said button cap where a pulling force applied to said papers being leafed tends to pull said button cap from said locking head of said button post, and that said button cap is capable of detaching from said locking head of said button cap when said cap is pulled to disengage from said locking head of said button cap at a side other than said locking side, wherein said means includes a post tube which is an upper portion of said post and made as a tubular body, a pair of first and second legs being provided at a top portion of said post tube as said locking head, wherein a top end of said first leg has a tooth pawl and a top end of said second leg has a smooth curve edge, wherein said means further includes a mouth formed at a downward edge of said cap hole, wherein one side of said mouth has a smooth curve portion while an opposite side has a sharp tooth latch, wherein when said locking head of said post engages in said cap hole of said button cap, said smooth curve portion and said smooth curved leg fit with each other to form a smooth curve site and said tooth pawl and said sharp tooth latch mesh with each other to form a tooth pawl site, wherein said button is able to be opened from said smooth curve site, wherein a split notch formed between said first and second legs enables said first and second legs easy to engage into said button cap.

2. The button binder, as recited in claim 1, wherein said means further comprises a locker post downwardly and coaxially extended from a cap base of said button cap into said cap hole, wherein when said button is closed, said locker post is extended and inserted into said split notch to hold said first leg in a locking position by eliminating a space between said locker post and said first leg to prevent said button being opened from said tooth pawl site, while leaving sufficient space between said locker post and said second leg to enable said button being opened from said smooth curve site.

3. The button binder, as recited in claim 1, wherein said cap hole is a through hole and said second leg is longer than said first leg and extended out of said cap hole, wherein said tooth pawl site is able to be unlocked by pushing an end of said second leg toward said first leg to disengage said tooth pawl with said sharp tooth latch so as to open said button.

4. The button binder, as recited in claim 3, wherein a top end of said second leg forms a handle which is inclined extended out of said cap hole of said button cap for opening said button by pushing down said handle.

5. A button binder for binding papers each having at least a punched hole along one edge thereof, wherein said button binder comprises at least a button which comprises:

a button post comprising a post constructed for passing through said punched holes of said papers and a locking head provided at a top end of said post;

a button cap having a cap hole for receiving said locking head of said post of said button post therein; and means for securely fastening said locking head in said cap hole at a designated direction for holding said papers between said button post and said button cap in such a manner that said button cap is tightly engaged with said locking head of said post of said button post at a locking side to prevent said button cap from pulling apart from said locking head of said button post while leafing through said papers bound between said button post and said button cap where a pulling force applied to said papers being leafed tends to pull said button cap from said locking head of said button post, and that said button cap is capable of detaching from said locking head of said button cap when said cap is pulled to disengage from said locking head of said button cap at a side other than said locking side, wherein said means comprises a pull piece which is extended from said button cap and arranged to pull said button cap to disengage from said locking head of said button cap at a side other than said locking side so as to detach said button cap from said button post, and a connection piece having one side extended to a bottom of said button post and another side connected to said button cap so as to ensure said button cap being fastened to said locking head of said button post at a designated direction, wherein said means further includes a post tube which is an upper portion of said post and made as a tubular body, a pair of first and second legs being provided at a top portion of said post tube as said locking head, wherein a top end of said first leg has a tooth pawl and a top end of said second leg has a smooth curve edge, wherein said means further includes a mouth formed at a downward edge of said cap hole, wherein one side of said mouth has a smooth curve portion while an opposite side has a sharp tooth latch, wherein when said locking head of said post engages in said cap hole of said button cap, said smooth curve portion and said smooth curved leg fit with each other to form a smooth curve site and said tooth pawl and said sharp tooth latch mesh with each other to form a tooth pawl site, wherein said button is able to be opened from said smooth curve site, wherein a split notch formed between said first and second legs enables said first and second legs easy to engage into said button cap.

6. The button binder, as recited in claim 5, wherein said means further comprises a locker post downwardly and coaxially extended from a cap base of said button cap into said cap hole, wherein when said button is closed, said locker post is extended and inserted into said split notch to hold said first leg in a locking position by eliminating a space between said locker post and said first leg to prevent said button being opened from said tooth pawl site, while leaving sufficient space between said locker post and said second leg to enable said button being opened from said smooth curve site.

7. The button binder, as recited in claim 5, wherein said cap hole is a through hole and said second leg is longer than said first leg and extended out of said cap hole, wherein said tooth pawl site is able to be unlocked by pushing an end of said second leg toward said first leg to disengage said tooth pawl with said sharp tooth latch so as to open said button.

8. The button binder, as recited in claim 7, wherein a top end of said second leg forms a handle which is inclinedly extended out of said cap hole of said button cap for opening said button by pushing down said handle.

9. A button binder for binding papers each having at least a punched hole along one edge thereof, wherein said button binder comprises at least a button which comprises:

a button post comprising a post constructed for passing through said punched holes of said papers and a locking head provided at a top end of said post;

a button cap having a cap hole for receiving said locking head of said post of said button post therein; and means for securely fastening said locking head in said cap hole at a designated direction for holding said papers between said button post and said button cap in such a manner that said button cap is tightly engaged with said locking head of said post of said button post at a locking side to prevent said button cap from pulling apart from said locking head of said button post while leafing through said papers bound between said button post and said button cap where a pulling force applied to said papers being leafed tends to pull said button cap from said locking head of said button post, and that said button cap is capable of detaching from said locking head of said button cap when said cap is pulled to disengage from said locking head of said button cap at a side other than said locking side;

wherein said button cap comprises a cap base which has a projection extended downwardly at a center of said cap base, wherein said projection has an enlarged portion at one end thereof and said button cap centrally has a button projection facing downwards with an axial hole which has a middle segment greater in diameter than an upper segment and a lower segment thereof, wherein said means comprises a spring which is holed in said middle segment and said projection of said cap base is pressed into said axial hole of said button cap, wherein said means further comprises an enlarged head provided at an upper end of said post of said button post as said locking head, wherein said enlarged head has a diameter larger than said button post and said button post is capable of piercing in a space where said spring is provided, wherein a latch notch is formed adjacent to a first side of said enlarged head and a smooth curve edge formed at an opposite second side of said latch notch, wherein when said button is closed that is said button cap is connected with said button post while said enlarged head is engaged with said button cap, one leg of said spring is arranged to mesh in said latch notch to form a locking site while another leg of said spring and said smooth curve edge of said enlarged head to form a smooth curve site, wherein said leg of said spring is retained securely in said latch notch so that said button is unable be opened from said locking site of said latch notch and said spring while said button is able to be opened from said smooth curve site.

10. A button binder for binding papers each having at least a punched hole along one edge thereof, wherein said button binder comprises at least a button which comprises:

a button post comprising a post constructed for passing through said punched holes of said papers and a locking head provided at a top end of said post;

a button cap having a cap hole for receiving said locking head of said post of said button post therein; and means for securely fastening said locking head in said cap hole at a designated direction for holding said papers between said button post and said button cap in such a manner that said button cap is tightly engaged with said locking head of said post of said button post at a locking side to prevent said button cap from pulling apart from said locking head of said button post while leafing through said papers bound between said button post and said button cap where a pulling force applied to said papers being leafed tends to pull said button cap from said locking head of said button post, and that said button cap is capable of detaching from said locking head of said button cap when said cap is pulled to disengage from said locking head of said button cap at a side other than said locking side, wherein said means comprises a pull piece which is extended from said button cap and arranged to pull said button cap to disengage from said locking head of said button cap at a side other than said locking side so as to detach said button cap from said button post, and a connection piece having one side extended to a bottom of said button post and another side connected to said button cap so as to ensure said button cap being fastened to said locking head of said button post at a designated direction;

wherein said button cap comprises a cap base which has a projection extended downwardly at a center of said cap base, wherein said projection has an enlarged portion at one end thereof and said button cap centrally has a button projection facing downwards with an axial hole which has a middle segment greater in diameter than an upper segment and a lower segment thereof, wherein said means comprises a spring which is holed in said middle segment and said projection of said cap base is pressed into said axial hole of said button cap tightly through said holes of said pull piece and said connection piece to affix said button cap on said connection piece, wherein said means further comprises an enlarged head provided at an upper end of said post of said button post as said locking head, wherein said enlarged head has a diameter larger than said button post and said button post is capable of piercing in a space where said spring is provided, wherein a latch notch is formed adjacent to a first side of said enlarged head and a smooth curve edge formed at an opposite second side of said latch notch, wherein when said button is closed that is said button cap is connected with said button post while said enlarged head is engaged with said button cap, one leg of said spring is arranged to mesh in said latch notch to form a locking site while another leg of said spring and said smooth curve edge of said enlarged head to form a smooth curve site, wherein said leg of said spring is retained securely in said latch notch so that said button is unable be opened from said locking site of said latch notch and said spring while said button is able to be opened from said smooth curve site.

11. A button binder for binding papers each having at least a punched hole along one edge thereof, wherein said button binder comprises at least a button which comprises:

a button post comprising a post constructed for passing through said punched holes of said papers and a locking head provided at a top end of said post;

a button cap having a cap hole for receiving said locking head of said post of said button post therein; and means for securely fastening said locking head in said cap hole at a designated direction for holding said papers between said button post and said button cap in such a manner that said button cap is tightly engaged with said locking head of said post of said button post at a locking side to prevent said button cap from pulling apart from said locking head of said button post while leafing through said papers bound between said button post and said button cap where a pulling force applied to said papers being leafed tends to pull said button cap from said locking head of said button post, and that said button cap is capable of detaching from said locking head of said button cap when said cap is pulled to disengage from said locking head of said button cap at a side other than said locking side;

wherein said button cap comprises a cap base which has a projection extended downwardly at a center of said cap base, wherein said projection has an enlarged portion at one end thereof and said button cap centrally has a button projection facing downwards with an axial hole which has a middle segment greater in diameter than an upper segment and a lower segment thereof, wherein said means comprises a spring which is holed in said middle segment and said projection of said cap base is pressed into said axial hole of said button cap, wherein said means further includes two latch teeth formed at a half periphery edge of said locking head of said post of said button head, wherein two notches are formed under said two latch teeth respectively while other opposite half circle part of said locking head has no latch teeth and is smooth to said notches while a smooth curve edge from said latch tooth transferring to said half circle part, wherein two legs of said spring are engaged in said two notches respectively when said button is closed, wherein said button is able to be opened from a side that has no latch teeth by said legs of said spring moving along said smooth curve edge, wherein said button is unable to opened at a side having said latch teeth.

12. A button binder for binding papers each having at least a punched hole along one edge thereof, wherein said button binder comprises at least a button which comprises:

a button post comprising a post constructed for passing through said punched holes of said papers and a locking head provided at a top end of said post;

a button cap having a cap hole for receiving said locking head of said post of said button post therein; and means for securely fastening said locking head in said cap hole at a designated direction for holding said papers between said button post and said button cap in such a manner that said button cap is tightly engaged with said locking head of said post of said button post at a locking side to prevent said button cap from pulling apart from said locking head of said button post while leafing through said papers bound between said button post and said button cap where a pulling force applied to said papers being leafed tends to pull said button cap from said locking head of said button post, and that said button cap is capable of detaching from said locking head of said button cap when said cap is pulled to disengage from said locking head of said button cap at a side other than said locking side, wherein said means comprises a pull piece which is extended from said button cap and arranged to pull said button cap to disengage from said locking head of said button cap at a side other than said locking side so as to detach said button cap from said button post, and a connection piece having one side extended to a bottom of said button post and another side connected to said button cap so as to ensure said button cap being fastened to said locking head of said button post at a designated direction;

wherein said button cap comprises a cap base which has a projection extended downwardly at a center of said cap base, wherein said projection has an enlarged portion at one end thereof and said button cap centrally has a button projection facing downwards with an axial hole which has a middle segment greater in diameter than an upper segment and a lower segment thereof, wherein said means comprises a spring which is holed in said middle segment and said projection of said cap base is pressed into said axial hole of said button cap, wherein said means further includes two latch teeth formed at a half periphery edge of said locking head of said post of said button head, wherein two notches are formed under said two latch teeth respectively while other opposite half circle part of said locking head has no latch teeth and is smooth to said notches while a smooth curve edge from said latch tooth transferring to said half circle part, wherein two legs of said spring are engaged in said two notches respectively when said button is closed, wherein said button is able to be opened from a side that has no latch teeth by said legs of said spring moving along said smooth curve edge, wherein said button is unable to opened at a side having said latch teeth.

13. A button binder for binding papers each having at least a punched hole along one edge thereof, wherein said button binder comprises at least a button which comprises:

a button post comprising a post constructed for passing through said punched holes of said papers and a locking head provided at a top end of said post;

a button cap having a cap hole for receiving said locking head of said post of said button post therein; and means for securely fastening said locking head in said cap hole at a designated direction for holding said papers between said button post and said button cap in such a manner that said button cap is tightly engaged with said locking head of said post of said button post at a locking side to prevent said button cap from pulling apart from said locking head of said button post while leafing through said papers bound between said button post and said button cap where a pulling force applied to said papers being leafed tends to pull said button cap from said locking head of said button post, and that said button cap is capable of detaching from said locking head of said button cap when said cap is pulled to disengage from said locking head of said button cap at a side other than said locking side;

wherein said button cap comprises a cap base which has a projection extended downwardly at a center of said cap base, wherein said projection has an enlarged portion at one end thereof and said button cap centrally has a button projection facing downwards with an axial hole which has a middle segment greater in diameter than an upper segment and a lower segment thereof, wherein said means comprises a spring which is holed in said middle segment and said projection of said cap base is pressed into said axial hole of said button cap, wherein said means further comprises an enlarged head provided at an upper end of said post of said button post as said locking head, wherein said enlarged head has a diameter larger than said button post and said button post is capable of piercing in a space where said spring is provided, wherein one side of said post has a flat surface and a first leg of said spring is a flat leg having a flat area to be engaged with said flat surface of said post together to form a locking site so as to prevent said button from being opened at said locking site while a second leg of said spring and a smooth curve edge of said enlarged head fit with each other to form a smooth curve site, wherein said leg of said spring is retained securely in said latch notch so that said button is unable be opened from said locking site while said button is able to be opened from said smooth curve site.

14. A button binder for binding papers each having at least a punched hole along one edge thereof, wherein said button binder comprises at least a button which comprises:

a button post comprising a post constructed for passing through said punched holes of said papers and a locking head provided at a top end of said post;

a button cap having a cap hole for receiving said locking head of said post of said button post therein; and means for securely fastening said locking head in said cap hole at a designated direction for holding said papers between said button post and said button cap in such a manner that said button cap is tightly engaged with said locking head of said post of said button post at a locking side to prevent said button cap from pulling apart from said locking head of said button post while leafing through said papers bound between said button post and said button cap where a pulling force applied to said papers being leafed tends to pull said button cap from said locking head of said button post, and that said button cap is capable of detaching from said locking head of said button cap when. said cap is pulled to disengage from said locking head of said button cap at a side other than said locking side, wherein said means comprises a pull piece which is extended from said button cap and arranged to pull said button cap to disengage from said locking head of said button cap at a side other than said locking side so as to detach said button cap from said button post, and a connection piece having one side extended to a bottom of said button post and another side connected to said button cap so as to ensure said button cap being fastened to said locking head of said button post at a designated direction;

wherein said button cap comprises a cap base which has a projection extended downwardly at a center of said cap base, wherein said projection has an enlarged portion at one end thereof and said button cap centrally has a button projection facing downwards with an axial hole which has a middle segment greater in diameter than an upper segment and a lower segment thereof, wherein said means comprises a spring which is holed in said middle segment and said projection of said cap base is pressed into said axial hole of said button cap, wherein said means further comprises an enlarged head provided at an upper end of said post of said button post as said locking head, wherein said enlarged head has a diameter larger than said button post and said button post is capable of piercing in a space where said spring is provided, wherein one side of said post has a flat surface and a first leg of said spring is a flat leg having a flat area to be engaged with said flat surface of said post together to form a locking site so as to prevent said button from being opened at said locking site while a second leg of said spring and a smooth curve edge of said enlarged head fit with each other to form a smooth curve site, wherein said leg of said spring is retained securely in said latch notch so that said button is unable be opened from said locking site while said button is able to be opened from said smooth curve site.

15. A button binder for binding papers each having at least a punched hole along one edge thereof, wherein said button binder comprises at least a button which comprises:

a button post comprising a post constructed for passing through said punched holes of said papers and a locking head provided at a top end of said post;

a button cap having a cap hole for receiving said locking head of said post of said button post therein; and means for securely fastening said locking head in said cap hole at a designated direction for holding said papers between said button post and said button cap in such a manner that said button cap is tightly engaged with said locking head of said post of said button post at a locking side to prevent said button cap from pulling apart from said locking head of said button post while leafing through said papers bound between said button post and said button cap where a pulling force applied to said papers being leafed tends to pull said button cap from said locking head of said button post, and that said button cap is capable of detaching from said locking head of said button cap when said cap is pulled to disengage from said locking head of said button cap at a side other than said locking side;

wherein said means comprises a turning latch plate at said button cap, wherein said turning latch plate is able to be turned at said button cap by hand, wherein a central hole formed in a center of said latch plate and said hole has a longer diameter in one direction and a shorter diameter in another direction, wherein said locking head of said post also has a latch having a longer diameter in one direction and a shorter diameter in said other direction, wherein said shorter diameter of said post is shorter than said shorter diameter of said hole, wherein said longer diameter of said post is shorter than said longer diameter of said hole, wherein said longer diameter of said post is longer than said shorter diameter of said hole, wherein said head latch of said post is able to be inserted into said hole, wherein by turning said turning latch plate, said latch of said post is locked by said shorter part of said hole.

16. A button binder for binding papers each having at least a punched hole along one edge thereof, wherein said button binder comprises at least a button which comprises:

a button post comprising a post constructed for passing through said punched holes of said papers and a locking head provided at a top end of said post;

a button cap having a cap hole for receiving said locking head of said post of said button post therein; and means for securely fastening said locking head in said cap hole at a designated direction for holding said papers between said button post and said button cap in such a manner that said button cap is tightly engaged with said locking head of said post of said button post at a locking side to prevent said button cap from pulling apart from said locking head of said button post while leafing through said papers bound between said button post and said button cap where a pulling force applied to said papers being leafed tends to pull said button cap from said locking head of said button post, and that said button cap is capable of detaching from said locking head of said button cap when said cap is pulled to disengage from said locking head of said button cap at a side other than said locking side, wherein said means comprises a pull piece which is extended from said button cap and arranged to pull said button cap to disengage from said locking head of said button cap at a side other than said locking side so as to detach said button cap from said button post, and a connection piece having one side extended to a bottom of said button post and another side connected to said button cap so as to ensure said button cap being fastened to said locking head of said button post at a designated direction;

wherein said means comprises a turning latch plate at said button cap, wherein said turning latch plate is able to be turned at said button cap by hand, wherein a central hole formed in a center of said latch plate and said hole has a longer diameter in one direction and a shorter diameter in another direction, wherein said locking head of said post also has a latch having a longer diameter in one direction and a shorter diameter in said other direction, wherein said shorter diameter of said post is shorter than said shorter diameter of said hole, wherein said longer diameter of said post is shorter than said longer diameter of said hole, wherein said longer diameter of said post is longer than said shorter diameter of said hole, wherein said head latch of said post is able to be inserted into said hole, wherein by turning said turning latch plate, said latch of said post is locked by said shorter part of said hole.

17. A button binder for binding papers each having at least a punched hole along one edge thereof, wherein said button binder comprises at least a button which comprises:

a button post comprising a post constructed for passing through said punched holes of said papers and a locking head provided at a top end of said post, wherein said post has an extensible structure so as to adjust a length of said post of said button post;

a button cap having a cap hole for receiving said locking head of said post of said button post therein; and means for securely fastening said locking head in said cap hole at a designated direction for holding said papers between said button post and said button cap in such a manner that said button cap is tightly engaged with said locking head of said post of said button post at a locking side to prevent said button cap from pulling apart from said locking head of said button post while leafing through said papers bound between said button post and said button cap where a pulling force applied to said papers being leafed tends to pull said button cap from said locking head of said button post, and that said button cap is capable of detaching from said locking head of said button cap when said cap is pulled to disengage from said locking head of said button cap at a side other than said locking side.

* * * * *